US006796255B2

(12) United States Patent
Ogi et al.

(10) Patent No.: US 6,796,255 B2
(45) Date of Patent: Sep. 28, 2004

(54) SEWING MACHINE FRAME HAVING REINFORCED STRUCTURE AND SEWING MACHINE PROVIDED WITH THE FRAME

(75) Inventors: Takeshi Ogi, Toyokawa (JP); Kaoru Sakakibara, Nagoya (JP); Tadashi Kimura, Komaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 61 days.

(21) Appl. No.: 10/255,607

(22) Filed: Sep. 27, 2002

(65) Prior Publication Data

US 2003/0066466 A1 Apr. 10, 2003

(30) Foreign Application Priority Data

Sep. 27, 2001 (JP) ..... P2001-295559
Sep. 27, 2001 (JP) ..... P2001-295560
Sep. 24, 2002 (JP) ..... P2002-277137

(51) Int. Cl.[7] ..... D05B 73/00
(52) U.S. Cl. ..... 112/258
(58) Field of Search ..... 112/258, 259, 112/260, 217.1; 108/25; 264/241, 13, 239, 542, DIG. 111, DIG. 117, DIG. 122

(56) References Cited

U.S. PATENT DOCUMENTS 2,411,459 A * 11/1946 Perkins et al. ..... 112/258
3,467,041 A * 9/1969 Greulich ..... 112/323
4,037,549 A * 7/1977 Hanyu et al. ..... 112/258
4,193,361 A * 3/1980 Johnson ..... 112/259
4,353,857 A * 10/1982 Ray et al. ..... 264/258
4,628,845 A * 12/1986 Matsuda ..... 112/259
5,566,707 A * 10/1996 Ching et al. ..... 137/359

FOREIGN PATENT DOCUMENTS

JP 11-137880 5/1999

* cited by examiner

*Primary Examiner*—Ismael Izaguirre
(74) *Attorney, Agent, or Firm*—Oliff & Berridge PLC

(57) ABSTRACT

A sewing machine frame having reinforced structure for use in a sewing machine is disclosed. The sewing machine frame has a frame member formed of a synthetic resin and having a bed portion, a tower portion upstanding from the bed portion, and an arm portion extending from the tower portion at a position above the bed portion, the bed portion, the tower portion and the arm portion being formed integrally and providing a concaved peripheral wall defining a stitch working space. The sewing machine frame is characterized by a peripheral wall reinforcing rib protruding from the frame member, the peripheral wall reinforcing rib extending along the peripheral wall and ranging at least from a boundary between the bed portion and the tower portion to a boundary between the tower portion and the arm portion.

41 Claims, 15 Drawing Sheets

1A
52
120
121
250
144
81
7
146
82
71
103
90
147
80
130
131
132
133
134
251
66
68

SEWING MACHINE FRAME HAVING REINFORCED STRUCTURE AND SEWING MACHINE PROVIDED WITH THE FRAME

BACKGROUND OF THE INVENTION

The present invention relates to a sewing machine frame made from a synthetic resin in which an arm portion, a tower portion and a bed portion are provided integrally. The present invention also relates to a sewing machine having the sewing machine frame.

In the sewing machine frame, a horizontally extending arm portion supports a reciprocation mechanism for a needle carrying a needle thread, and the tower portion vertically extends from the bed portion for supporting the arm portion in a cantilevered fashion. In the bed portion, a loop taker is supported for trapping a loop of the needle thread carried on the vertically reciprocating needle in order to form a stitch.

In the sewing machine, a smooth stitching operation is required. To this effect, vibration and displacement of a needle tip due to the vertically reciprocating motion of the needle must be reduced or minimized, otherwise a loop seizing beak of the loop taker disposed in the bed portion cannot trap the needle thread loop formed by vertical reciprocation of the sewing needle. Thus, the stitching may be degraded.

In order to avoid this problem, the needle & rotary hook timing must be adequately provided. To this effect, the sewing machine frame must provide high rigidity capable of avoiding deformation or displacement thereof due to reaction force occurring when the needle penetrates a workpiece fabric. Therefore, in the conventional sewing machine, a metallic frame having high rigidity is provided in an interior of a sewing machine cover, and a stitch forming mechanism including a needle vertical reciprocating mechanism and the loop taker is attached to the metallic frame.

However, such a conventional arrangement is costly, bulky and heavy. More specifically, the sewing machine frame has a rigid box shape arrangement in order to provide high rigidity. Further, the frame is made from a metal such as a cast iron or aluminum, which in turn increase weight and size. Further, high skill and elaboration is required for assembling the sewing machine because the stitch forming mechanism must be installed into the metallic frame through a small area opening thereof. This increases assembly cost.

Laid open Japanese Patent Application Kokai No. Hei-11-137880 discloses a sewing machine frame made from a synthetic resin to reduce production cost and to provide a light weight frame. As shown in FIG. 16, the frame 300 has an open end arrangement in a U-shape cross-section in which a bed portion 304, a tower portion 303 and an arm portion 302 are provided integrally, and a reinforcing plate 301 is fixed between upper and lower portions at the open end of the bed portion 304.

However, the disclosed sewing machine frame 300 provides a rigidity still lesser than that of the metallic frame. More specifically, as shown in FIG. 16, vertical vibration occurs in the arm portion 302 due to a load exerted along a vertical line containing the needle, the load being caused by the reciprocating motion of the needle during stitching operation. Further, a horizontal swing also occurs at an upper portion of the tower portion 303 during stitching.

Such vibration and swing occur due to the cantilevered support structure of the arm portion 302 with respect to the tower 303. That is, a combination of the arm portion 303, the tower portion 303 and the bed portion 304 provides an arcuate recessed wall 305, and a stress generated by the vertically reciprocating motion of the needle will be concentrated on the wall 305. However, the wall 305 does not have a sufficient rigidity, and therefore, such unwanted vibration and swing occur to lower stitching quality in comparison with the conventional sewing machine provided with the metallic frame.

SUMMARY OF THE INVENTION

It is an object of the present invention to overcome the above-described problems and to provide a sewing machine frame having a bed portion, a tower portion and an arm portion those integrally with each other and formed of a synthetic resin, yet having high rigidity, and to provide a sewing machine having such an improved sewing machine frame.

This and other objects of the present invention will be attained by a sewing machine frame for use in a sewing machine including a frame member, and a peripheral wall reinforcing rib. The frame member is formed of a synthetic resin and has a bed portion, a tower portion upstanding from the bed portion, and an arm portion extending from the tower portion at a position above the bed portion. The bed portion, the tower portion and the arm portion are formed integrally and provide a concaved peripheral wall defining a stitch working space. The peripheral wall reinforcing rib protrudes from the frame member. The peripheral wall reinforcing rib extends along the peripheral wall and ranges at least from a boundary between the bed portion and the tower portion to a boundary between the tower portion and the arm portion.

In another aspect of the invention, there is provided a sewing machine frame for use in a sewing machine including an outer panel wall, a side wall, a peripheral wall reinforcing rib, and an outer panel wall reinforcing rib. The outer panel wall constitutes a front wall and a rear wall and has a peripheral edge. The side wall protrudes from the peripheral edge to provide a closed space with the outer panel wall and is formed integrally with the outer panel wall with a synthetic resin. A combination of the outer panel wall and the side wall provides a bed portion, a tower portion upstanding from the bed portion, and an arm portion extending from the tower portion and positioned above the bed portion. The side wall has a part providing a concaved peripheral wall which defines a stitch working space surrounded by the bed portion, the tower portion and the arm portion. The peripheral wall reinforcing rib protrudes from the outer panel wall and extends along the peripheral wall. The peripheral wall reinforcing rib ranges at least from a boundary between the bed portion and the tower portion to a boundary between the tower portion and the arm portion. The outer panel wall reinforcing rib protrudes from the outer panel wall for reinforcing the same.

In still another aspect of the invention, there is provided a sewing machine frame including a bed portion, a tower portion upstanding from the bed portion, and an arm portion extending from the tower portion in a cantilevered fashion, a stitch forming mechanism of the sewing machine being assembled in the sewing machine frame. The sewing machine frame includes an integral main frame body, an integral frame cover and a concave wall reinforcing rib. The integral main frame body is made from a synthetic resin and to which the stitch forming mechanism is assembled. The integral main frame body includes a back panel wall having a first peripheral edge, and a first side wall integrally protruding from the first peripheral edge. The integral main frame body provides an arm section, a tower section and a bed section. The integral frame cover is made from a synthetic resin and is attached to the main frame body. The integral frame cover includes a front panel wall having a second peripheral edge, and a second side wall integrally protruding from the second peripheral edge for providing a complementary bed section to form the bed portion with the bed section, a complementary tower section to form the tower portion with the bed section, and a complementary arm section to form the arm portion with the arm section. The first side wall and the second side wall have parts defining a concave wall surroundingly provided by the combination of the arm portion, the tower portion, and the bed portion. The concave wall reinforcing rib extends along the concave wall and ranges at least from a boundary between the bed portion and the tower portion to a boundary between the tower portion and the arm portion.

In still another aspect of the invention, there is provided a sewing machine frame for use in a sewing machine including an outer panel wall, a side wall, and a reinforcing member. The outer panel wall constitutes a front wall and a rear wall. The side wall protrudes from a peripheral edge of the outer panel wall to provide a closed space with the outer panel wall and is formed integrally with the outer panel wall with a synthetic resin. A combination of the outer panel wall and the side wall provides a bed portion extending in its longitudinal direction, a tower portion upstanding from the bed portion, and an arm portion extending in its longitudinal direction from the tower portion and positioned above the bed portion. A congregated area among the bed portion, the tower portion and the arm portion provides a concaved peripheral wall defining a stitch working space of the sewing machine. The reinforcing member is formed integrally with the outer panel wall and has a generally semi-circular hollow cross-section. The reinforcing member is positioned along the peripheral wall and has one end portion positioned in the arm portion and extending in the longitudinal direction thereof, and has another end portion positioned in the bed portion and extending in the longitudinal direction thereof.

In still another aspect of the invention, there is provided a sewing machine frame including a bed portion, a tower portion upstanding from the bed portion, and an arm portion extending from the tower portion in a cantilevered fashion, a stitch forming mechanism of a sewing machine being assembled in the sewing machine frame. The sewing machine frame includes an integral main frame body, an integral frame cover, and a reinforcing member. The integral main frame body is made from a synthetic resin and to which the stitch forming mechanism is assembled. The integral main frame body includes a back panel wall having a peripheral edge, and a side wall integrally protruding from the peripheral edge. The integral main frame body provides an arm section, a tower section and a bed section. The side wall has a part defining a peripheral wall surroundingly provided by the combination of the arm section, the tower section and the bed section. The integral frame cover serves as a front panel wall and is made from a synthetic resin and is attached to the main frame body for providing a complementary bed section to form the bed portion with the bed section, a complementary tower section to form the tower portion with the tower section, and a complementary arm section to form the arm portion with the arm section. The reinforcing member is formed integrally with the main frame body and has a generally semi-circular hollow cross-section. The reinforcing member is positioned along the peripheral wall and has one end portion positioned in the arm section and extending in the longitudinal direction thereof, and has another end portion positioned in the bed section and extending in the longitudinal direction thereof.

In still another aspect of the invention, there is provided a sewing machine including a stitch forming mechanism and any one of the above-described sewing machine frames.

BRIEF DESCRIPTION OF THE DRAWINGS

The aforementioned aspects and other features of the invention are explained in the following description, taken in connection with the accompanying drawing figures wherein.

DETAILED DESCRIPTION OF THE PREFERRED EMBODIMENTS

Structure of a Sewing Machine

Figure 1:
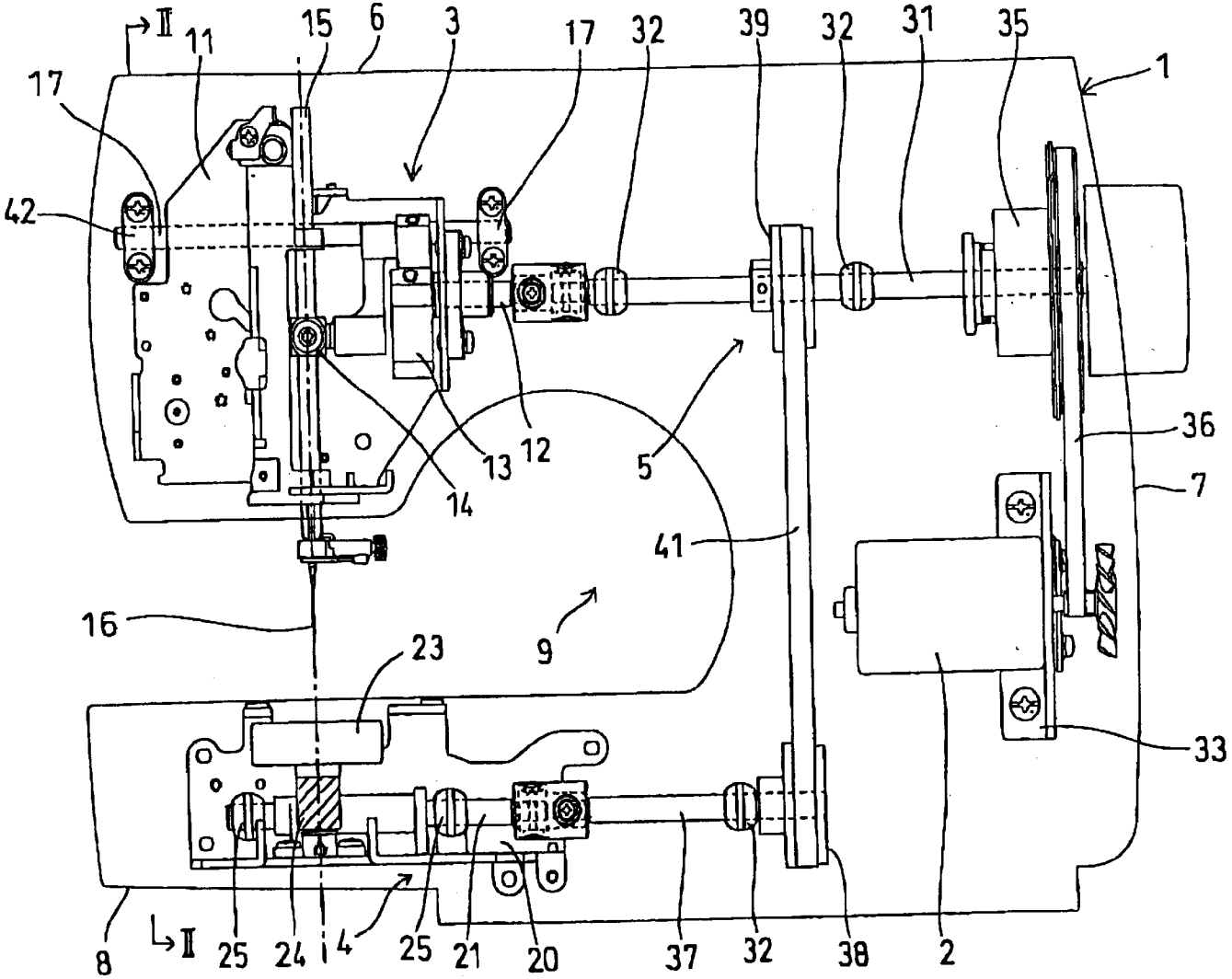
FIG. 1 is a front view showing the overall construction of a sewing machine comprising a frame according to the preferred embodiment.
Figure 2:
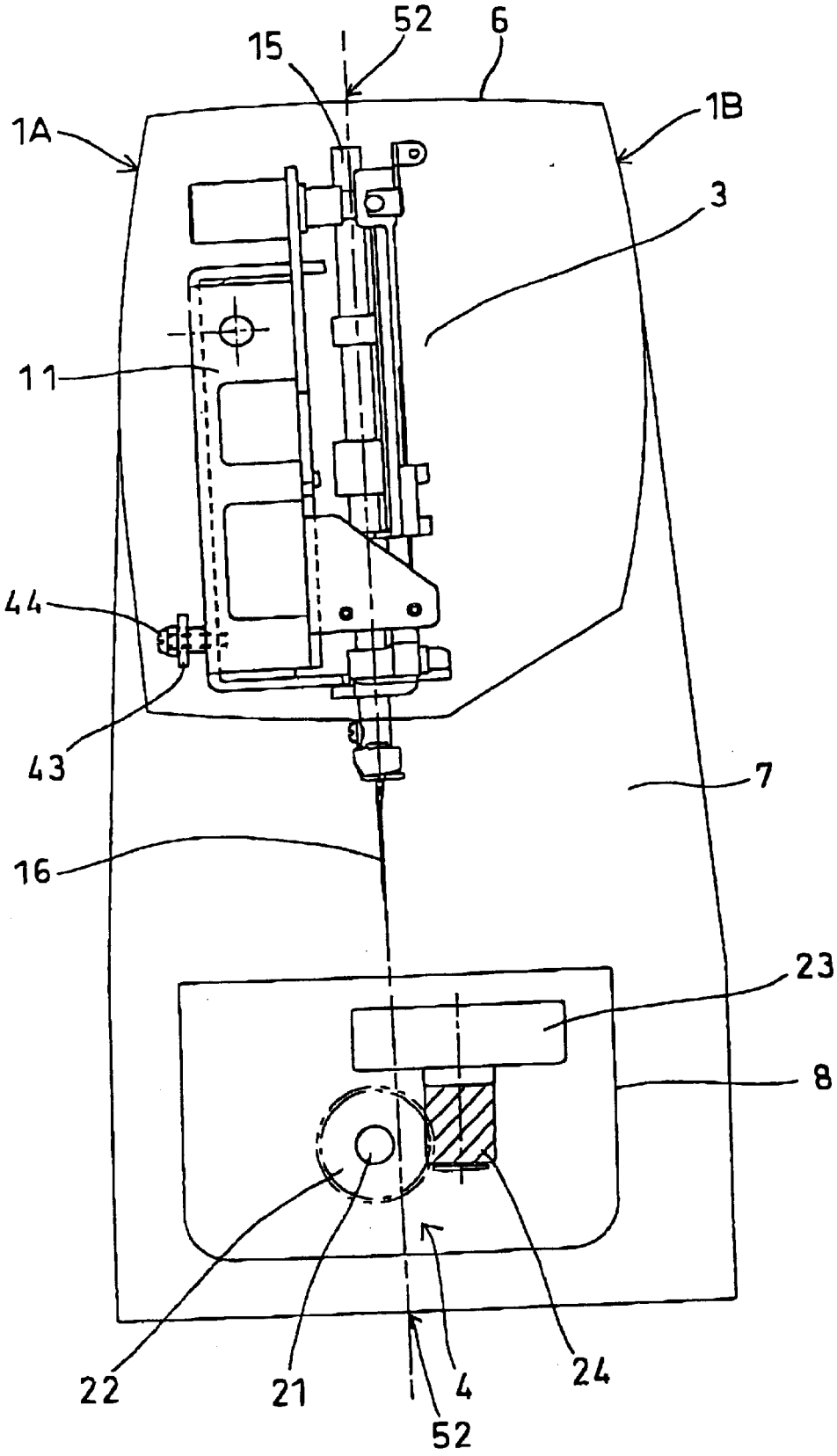
FIG. 2 is a side view showing the overall construction of the sewing machine in FIG. 1.

A sewing machine frame according to a preferred embodiment of the present invention will be described while referring to the accompanying drawings. First the overall construction of a sewing machine comprising a frame according to the preferred embodiment will be described with reference to FIGS. 1 and 2. FIG. 1 is a front view, and FIG. 2 is a side view showing the overall construction of the sewing machine comprising a frame 1 according to the preferred embodiment.

As shown in FIG. 1, the frame 1 substantially comprises a bed 8, a cantilever support 7 provided vertically on the bed 8, an arm 6, and an arm 6 cantilevered from the cantilever support 7 above the bed 8. The bed 8, the cantilever support 7, and the arm 6 are integrally formed of a synthetic resin in a substantially C shape.

The frame 1 supports a stitch forming mechanism including a loop taker and a mechanism for driving a needle 16 reciprocally up and down, and constitutes a shell of the sewing machine. In other words, the frame 1 does not need any metallic frame for mounting the stitch forming mechanism. Accordingly, it is possible to manufacture a lighter frame 1 having simplified structure, compared with a conventional metal frame to mount a stitch forming mechanism, covering with a resin cover. The frame 1 may be formed of a synthetic resin material by using a well-known injection molding method.

The synthetic resin material for the frame 1 may be a noncrystalline thermoplastic resin, such as a styrene resin. More specifically, the material may be one or mixture of acrylonitrile-butadiene-styrene copolymer, polystyrene, acrylonitrile-styrene, acrylonitrile-acrylate-styrene, acrylonitrile-ethylene-styrene, chlorinated acrylonitrile-polyethylene-styrene. Of these materials, a resinous matter having acrylonitrile-butadiene-styrene copolymer as the primary component with an inorganic additive of talc or glass bead has good rigidity and a good thermal expansion coefficient. The usage of the above material may eliminate frame coating in the later step due to a good appearance of the frame.

The arm 6 supports a top mechanism 3 for reciprocally driving the needle 16 up and down, the needle 16 retaining needle thread. A motor 2 provided in the cantilever support 7 generates rotational motion. The top mechanism 3 converts this rotational motion to reciprocal motion by means of a crank mechanism to transfer the reciprocal motion to the needle 16. The top mechanism 3 comprises a spindle 12, a thread take-up crank 13, a needle bar holder 14, a needle bar 15, and a thread take-up lever link hinge pin 17 mounted in a metal top frame 11. The top frame 11 is directly attached to the frame 1 by several screws.

Next, the operations of the top mechanism 3 will be described. A rotational driving force generated by the motor 2 is transferred to a large pulley 35 via a motor belt 36. The rotational driving force transferred to the large pulley 35 is further transferred to the thread take-up crank 13 via an arm shaft 31 and the spindle 12. The arm shaft 31 is rotatably supported by two bearings 32, 32. The spindle 12 is linked to the arm shaft 31 via a coupler. Through the movement of a needle bar crank rod, rotational motion transferred to the thread take-up crank 13 is converted to reciprocal motion of the needle bar 15 that is supported rotatably on the needle bar holder 14. The needle bar 15 is capable of moving vertically in the needle bar holder 14. This reciprocal motion is transferred to the needle 16.

The arm 6 is supported on the top end of the cantilever support 7, while the bed 8 is connected to the bottom end of the cantilever support 7. A drive transferring mechanism 5 is disposed in the cantilever support 7 for transferring rotational driving force generated by the motor 2 to the top mechanism 3 housed in the arm 6 and a lower mechanism 4 housed in the bed 8. The drive transferring mechanism 5 comprises the motor 2, the large pulley 35, the motor belt 36, a pulley 38, a pulley 39, and a timing belt. The drive transferring mechanism 5 is directly attached to the frame 1. The motor 2 is supported by motor supporting brackets 33 that are fixed near the bottom end of the cantilever support 7.

Next, the operations of the drive transferring mechanism 5 will be described. The rotational driving force provided by the motor 2 is transferred to the large pulley 35 via the motor belt 36. The rotational driving force transferred to the large pulley 35 is then transferred to the arm shaft 31 rotatably supported by the two bearings 32, 32. As described above, this rotational motion is transferred to the top mechanism 3 via the spindle 12, while this movement is also transferred to the lower mechanism 4. That is, the pulley 39 is fixed at approximately the center point of the arm shaft 31. Rotational motion transferred to the pulley 39 is further transferred to the pulley 38 disposed in the bed 8 via the timing belt 41. A rotary hook shaft 37 is rotatably supported by a bearing 32. Since the rotary hook shaft 37 is linked to the pulley 38, the rotary hook shaft 37 rotates in synchronization with the rotations of the arm shaft 31 due to the rotational motion of the pulley 38.

The cantilever support 7 is formed on one end of the bed 8. The bed 8 supports a rotary hook 23 constituting a loop taker for catching a thread loop of the needle thread as the needle moves up and down and forming a stitch. The lower mechanism 4 is provided inside the bed 8 for rotating the rotary hook 23 in synchonization with the reciprocal motion of the needle 16. The lower mechanism 4 comprises a rotary hook shaft 21, a helical gear 22, the rotary hook 23, a helical gear 24, and the rotary hook shaft 37 mounted on a metal lower frame 20. The lower frame 20 is mounted directly on the frame 1 by a plurality of screws.

Next, the operations of the lower mechanism 4 will be described. The rotational motion transferred via the timing belt 41 to the pulley 38 is transferred to the helical gear 22 via the rotary hook shaft 37 rotatably supported by the bearing 32 and the rotary hook shaft 21 rotatably supported by two bearings 25, 25 and linked to the rotary hook shaft 37 via a coupler. As shown in FIG. 2, the helical gear 22 is fixed on the rotary hook shaft 21. A rotary hook shaft on which the rotary hook 23 is fixed is rotatably supported on the lower frame 20 for rotating beneath the top surface of the bed 8. The helical gear 24 engaged with the helical gear 22 is fixed to the rotary hook shaft. Accordingly, when the rotary hook shaft 21 rotates, the rotary hook 23 rotates via the helical gear 22 and helical gear 24. At the same time, A loop seizing beak of the loop taker moves in synchronization with the tip of the needle 16, and catches the thread loop of the needle thread supported on the needle 16 as the needle 16 moves vertically.

Sewing Machine Frame

In order to execute smooth sewing operations with a sewing machine having the construction described above, it is necessary to minimize vibration caused by the vertical movement of the needle 16. Simultaneously, displacement of the needle tip caused by deformation of the frame 1 due to the vertical movement of the needle 16 is required to be minimized. This is because large amount of the displacement and the vibration of the needle tip can prevent the loop seizing beak of the loop taker provided in the bed 8 from catching the thread loop, resulting in the formation of an inappropriate stitch. To avoid this, it is necessary to maintain at all times an appropriate needle and rotary hook timing between the loop seizing beak of the rotating rotary hook 23 and the needle 16 that is moved reciprocally up and down. Accordingly, the frame 1 must have high rigidity in order to prevent deformation (displacement) due to a reaction force generated when the needle penetrates a working piece cloth. However, since it is difficult to maintain sufficient rigidity in a frame formed of synthetic resin, the frame 1 of the present embodiment employs various constructions to achieve sufficient rigidity.

As shown in FIG. 2, the frame 1 is formed of a main frame 1A and a frame cover 1B along a dividing plane 52 formed in approximately the center of the periphery of the frame 1 when viewed from the end (the dotted line in FIG. 2). The main frame 1A is provided with the stitch forming mechanism including the top mechanism 3 for driving the needle 16 reciprocally up and down and the lower mechanism 4 for rotating the rotary hook 23 is mounted. The frame cover 1B is coupled to the main frame 1A to cover the stitch forming mechanism.

Figure 4:
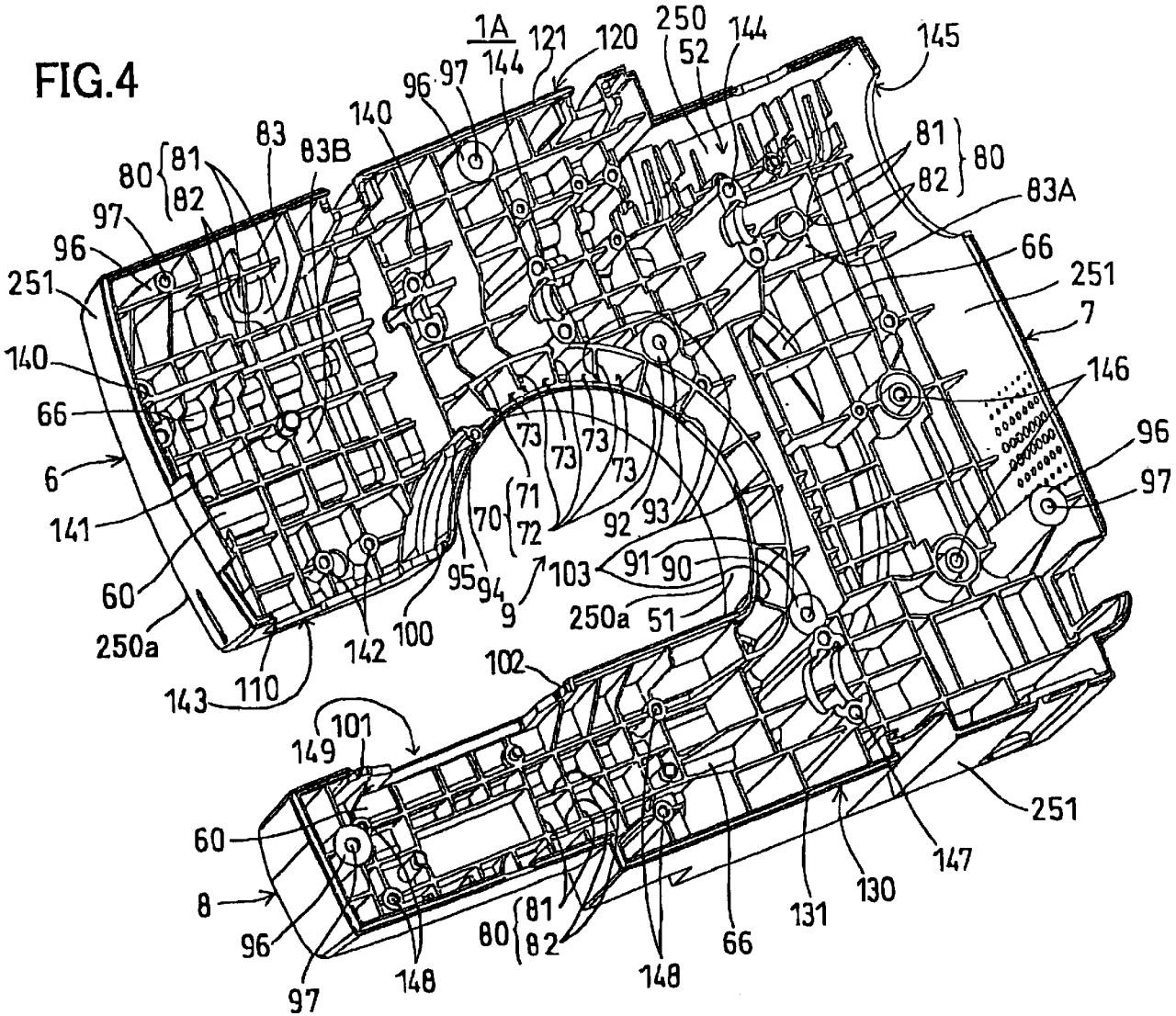
FIG. 4 is a perspective view showing the internal construction of the main frame.
Figure 11:
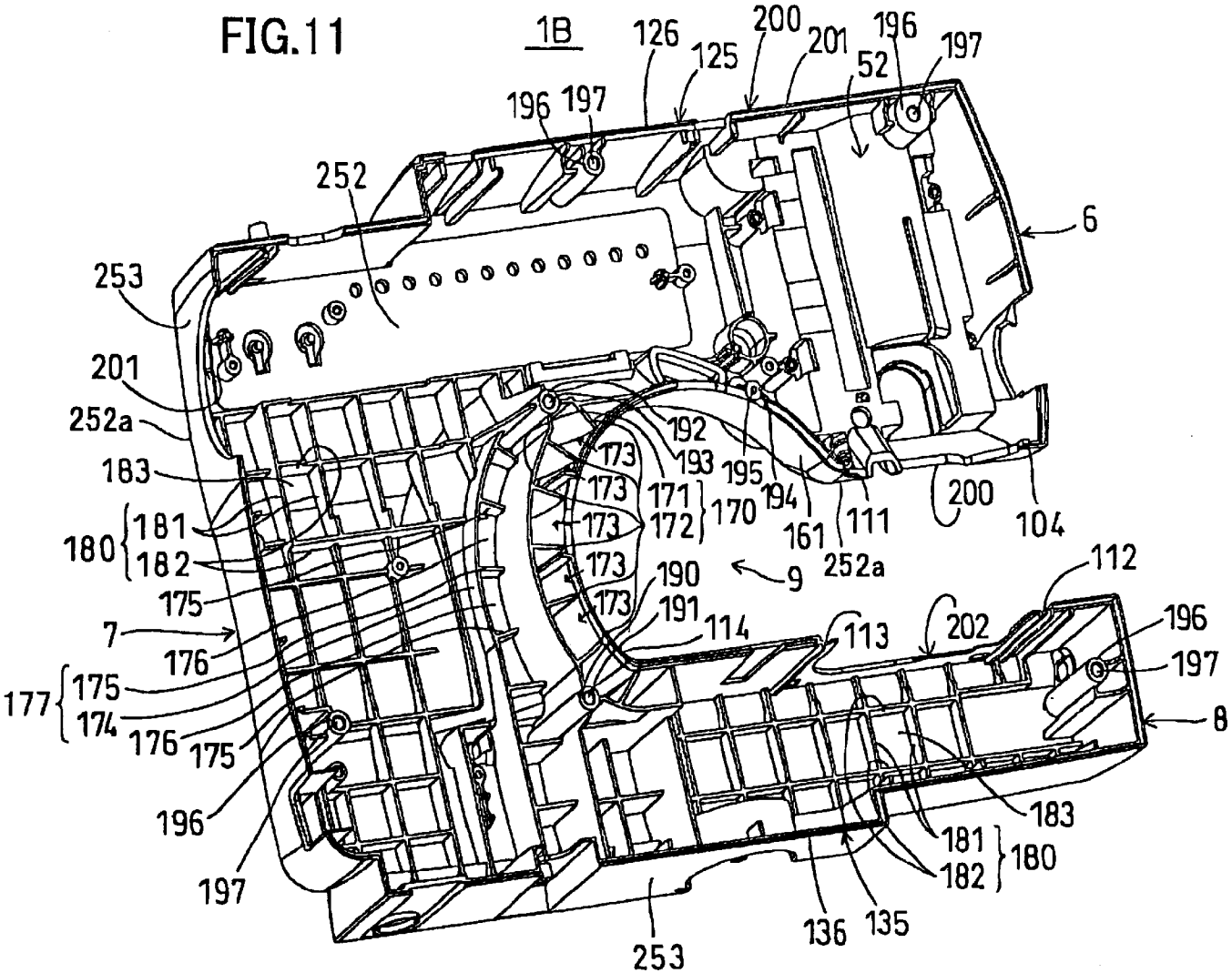
FIG. 11 is a perspective view showing the internal construction of the frame cover.

The insides of the main frame 1A and frame cover 1B are configured to accommodate the top mechanism 3 and the lower mechanism, as shown when the main frame 1A and frame cover 1B are in an open state divided along the dividing plane 52 (refer to FIGS. 4 and 11). When assembling the sewing machine, the top mechanism 3 and the lower mechanism are first mounted in the main frame 1A while the main frame 1A is rendered in an open state. The main frame 1A and frame cover 1B are then joined together by inserting screws through couplings 90, 190 provided in the main frame 1A and the frame cover 1B (see FIGS. 4 and 11). By simplifying the process for assembling the sewing machine in this way, it is possible to reduce the assembly costs. Since the open area of the frame is closed after assembly, the frame retains sufficient rigidity, and the arm 2 is not easily subject to torsional deformation due to reciprocal motion of the needle 16.

Main Frame

Figure 3:
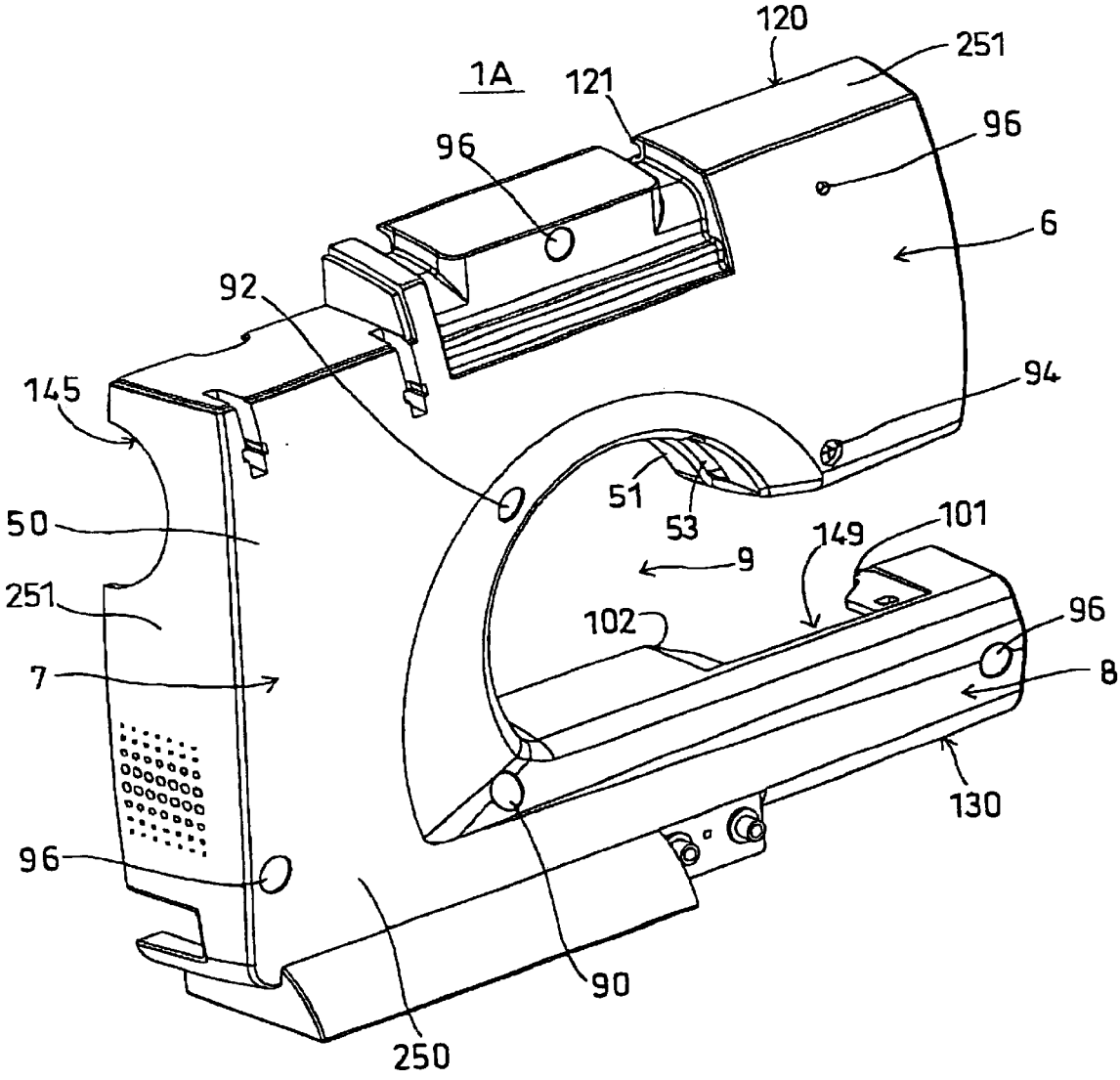
FIG. 3 is a perspective view showing the external appearance of a main frame.
Figure 5:
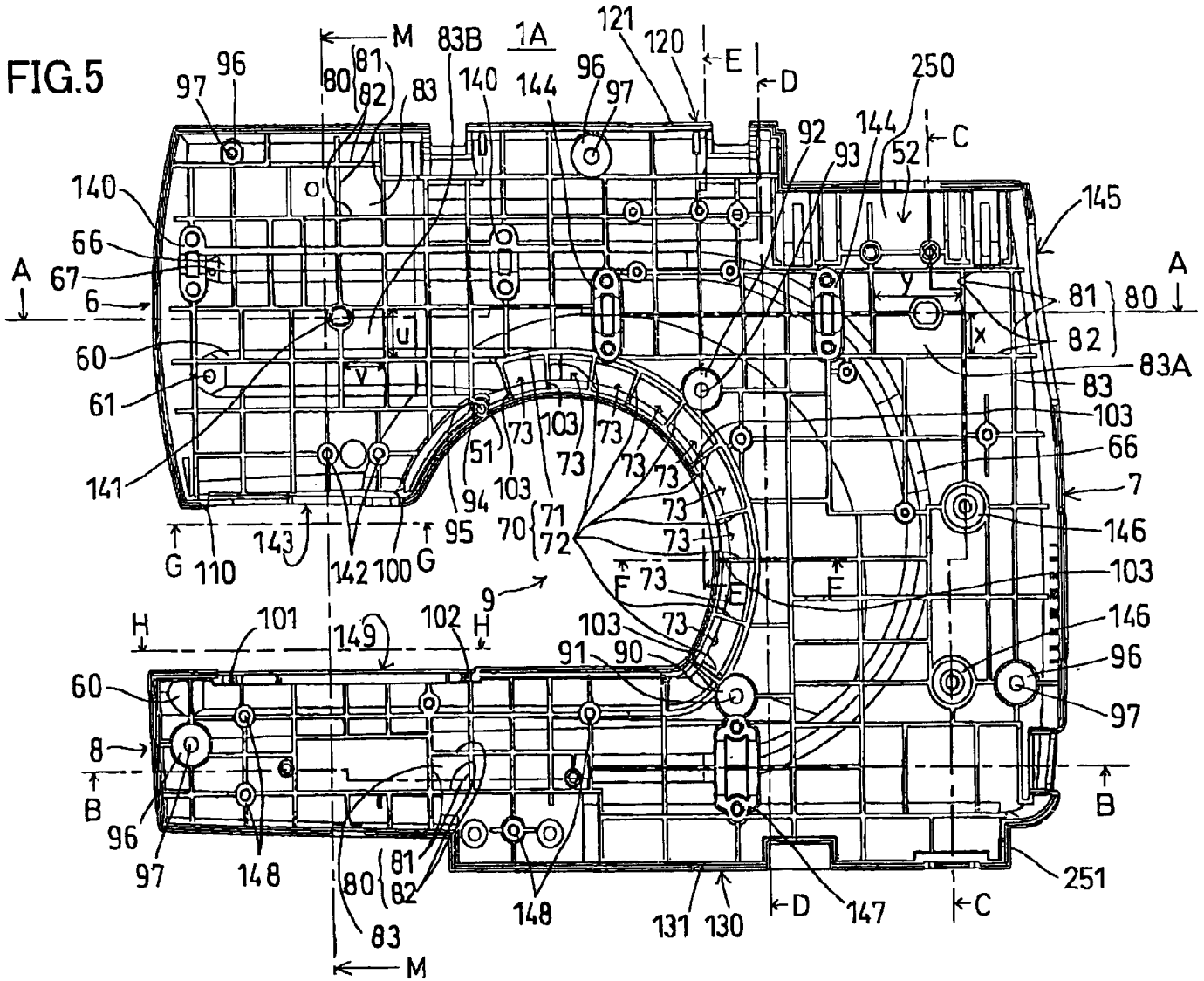
FIG. 5 is a plan view showing the internal construction of the main frame.
Figure 6A:
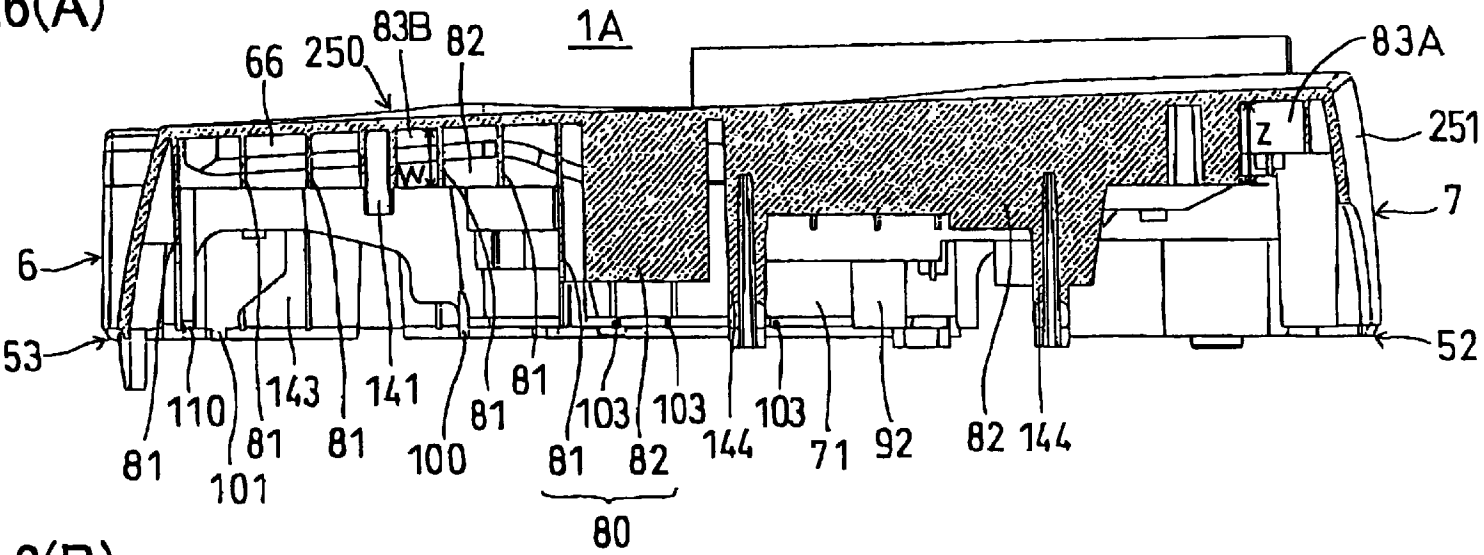
FIG. 6(A) is a cross-sectional view along the plane of the main frame indicated by the arrows A in FIG. 5.
Figure 6B:
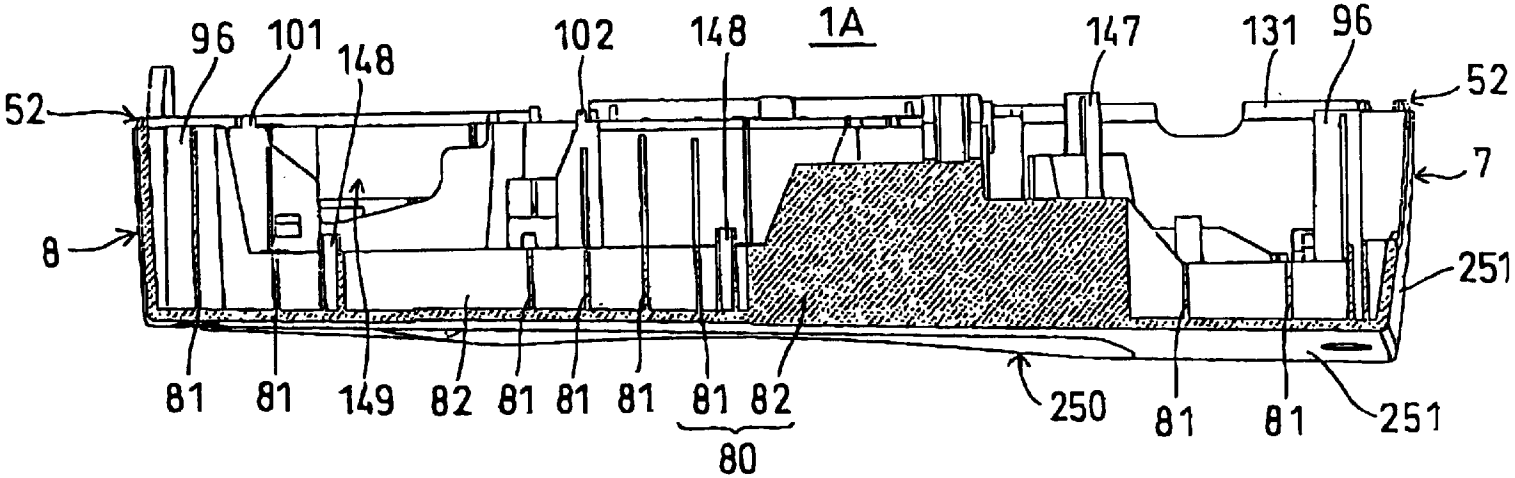
FIG. 6(B) is a cross-sectional view along the plane of the main frame indicated by the arrows B in FIG. 5.
Figures 7A, 7B, 7C:
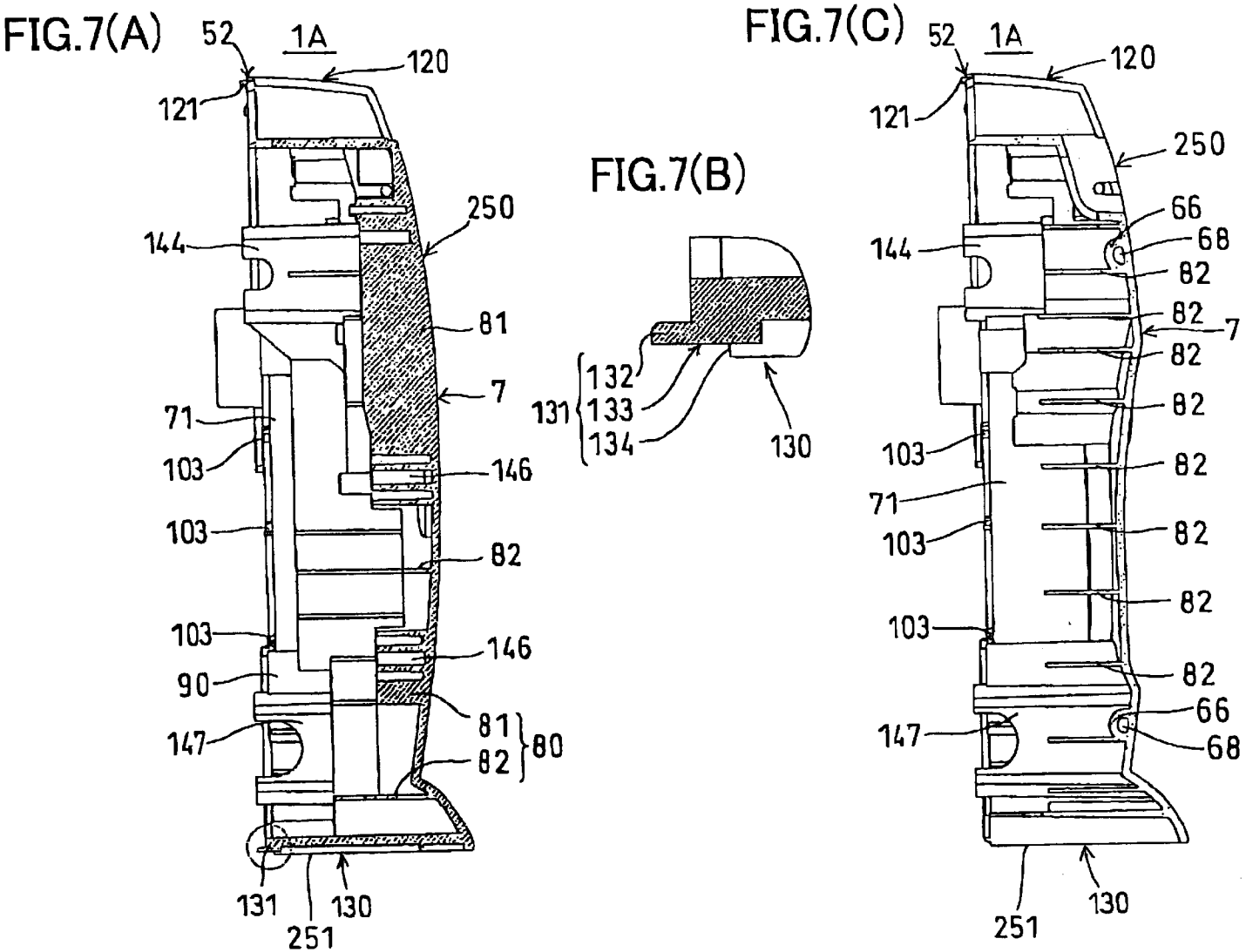
FIG. 7(A) is a cross-sectional view along the plane of the main frame indicated by the arrows C in FIG. 5.
FIG. 7(B) is an enlarged view showing the lower end of the main frame.
FIG. 7(C) is a cross-sectional view along the plane of the main frame indicated by the arrows D in FIG. 5.
Figure 8A:
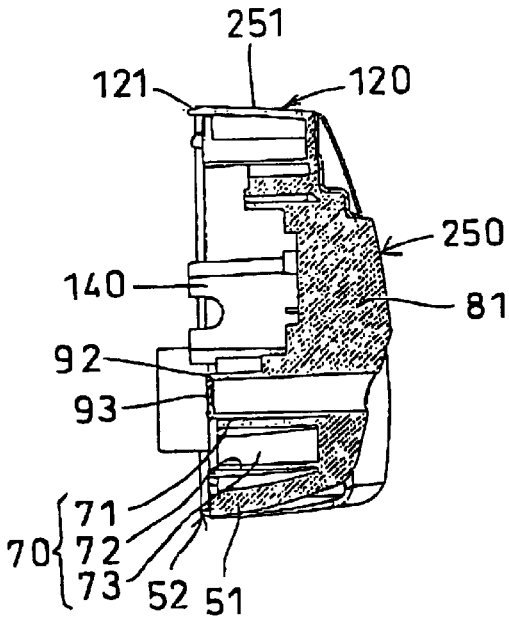
FIG. 8(A) is a cross-sectional view along the plane of the main frame indicated by the arrows E in FIG. 5.
Figure 8B:
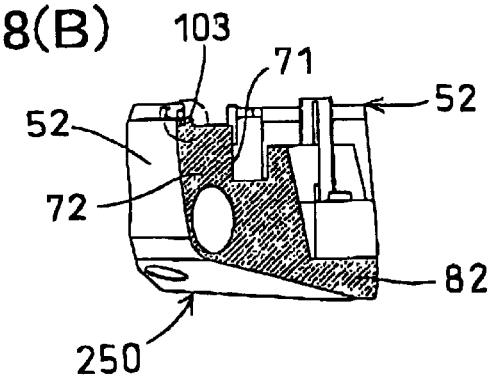
FIG. 8(B) is a cross-sectional view along the plane of the main frame indicated by the arrows F in FIG. 5.
Figure 8C:
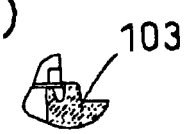
FIG. 8(C) is an enlarge view of a protrusion.
Figure 8D:
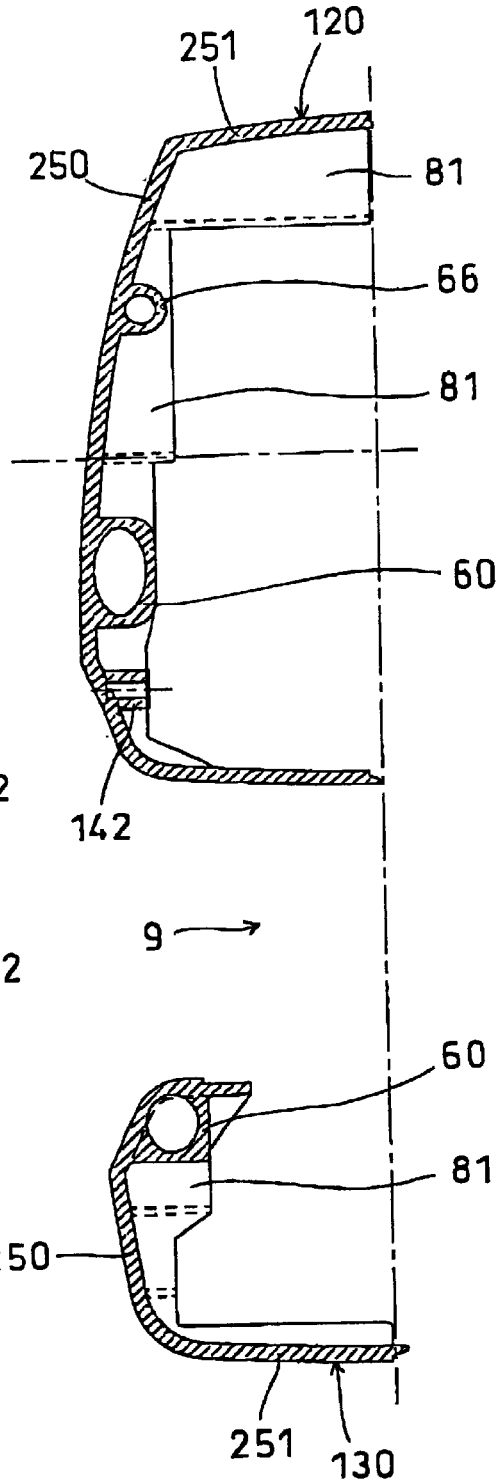
FIG. 8(D) is a cross-sectional view along the plane of the main frame indicated by the arrows M in FIG. 5.
Figure 9A:
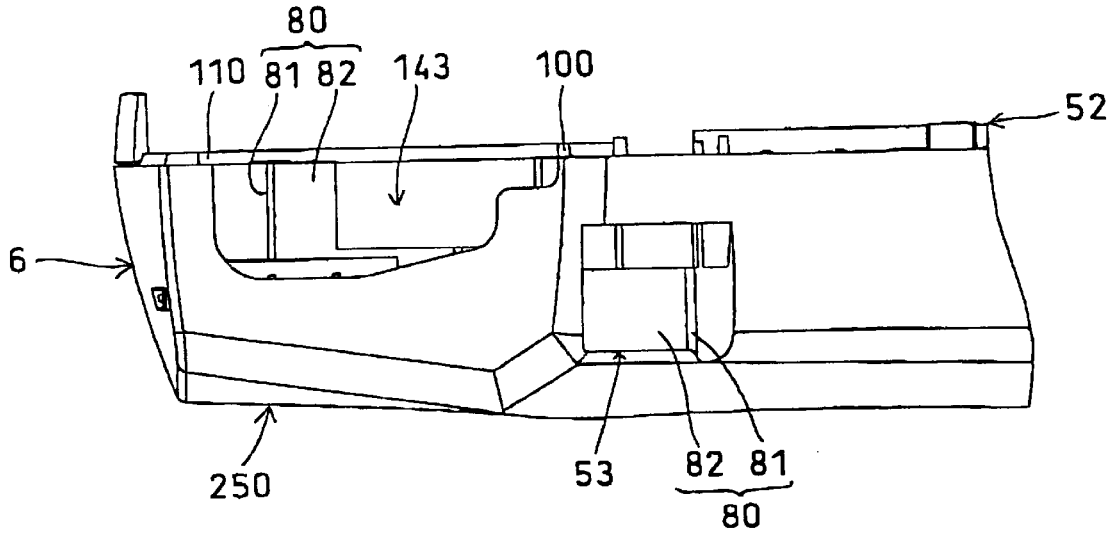
FIG. 9(A) is an enlarged plan view showing the main frame from the perspective of the line G in FIG. 5.
Figure 9B:
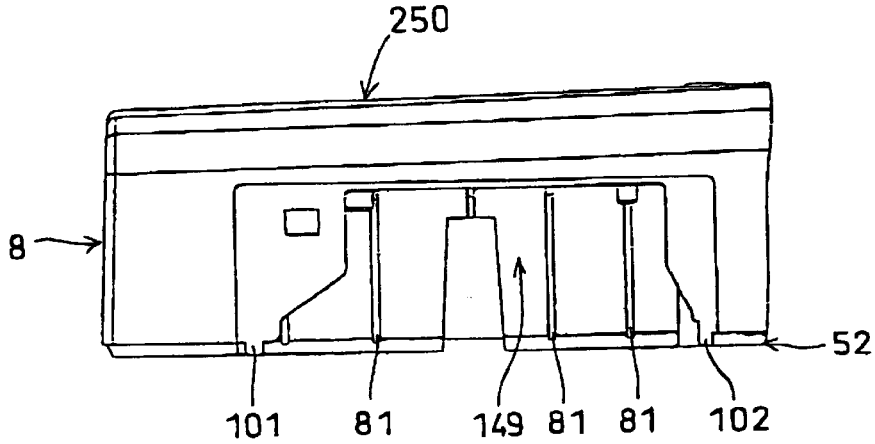
FIG. 9(B) is an enlarged plan view showing the main frame from the perspective of the line H in FIG. 5.

Next, the main frame 1A of the frame 1 will be described with reference to FIGS. 3 through 9. FIG. 3 is a perspective view showing the external appearance of the main frame 1A. FIG. 4 is a perspective view showing the internal construction of the main frame 1A. FIG. 5 is a plan view showing the internal construction of the main frame 1A. FIG. 6(A) is a cross-sectional view along the plane of the main frame 1A indicated by the arrows A in FIG. 5. FIG. 6(B) is a cross-sectional view along the plane of the main frame 1A indicated by the arrows B in FIG. 5. FIG. 7(A) is a cross-sectional view along the plane of the main frame 1A indicated by the arrows C in FIG. 5. FIG. 7(B) is an enlarged view showing the lower end of the main frame 1A. FIG. 7(C) is a cross-sectional view along the plane of the main frame 1A indicated by the arrows D in FIG. 5. FIG. 8(A) is a cross-sectional view along the plane of the main frame 1A indicated by the arrows E in FIG. 5. FIG. 8(B) is a cross-sectional view along the plane of the main frame 1A indicated by the arrows F in FIG. 5. FIG. 8(C) is an enlarge view of a protrusion shown in FIG. 8(B). FIG. 8(D) is a cross sectional view along the plane of the main frame 1A indicated by the arrows M. FIG. 9(A) is an enlarged plan view showing the main frame 1A from the perspective of the line G in FIG. 5. FIG. 9(B) is an enlarged plan view showing the main frame 1A from the perspective of the line H in FIG. 5.

As shown in FIG. 3, the main frame 1A substantially comprises the arm 6, the cantilever support 7, and the bed 8 formed integrally. The semicircular space surrounded by the arm 6, cantilever support 7, and bed 8 is a space 9.

In addition, the main frame 1A comprises a back panel wall 250 constituting a back side of the sewing machine, and side wall 251 extending from a peripheral edge 250*a* of the back panel wall 250. Especially, the surface of the main frame 1A facing the space 9 is designated as an inner surface wall 51. The inner surface wall 51 has a rectangular opening 53 that a cloth-pressing lever for fabric (not shown) is passed through.

As shown in FIGS. 1, 4 and 5, the main frame 1A is provided with an arrangement for mounting stitch forming mechanism. More specifically, the interior of the arm 6 is provided with a pair of thread take-up shaft supports 140, 140 for rotatably supporting the thread take-up lever link hinge pin (not shown); a needle bar holder mount 141 on which the needle bar holder 14 is mounted; an upper frame mount 142 on which the top frame 11 is mounted; and a pair of arm shaft supports 144, 144 for rotatably supporting the arm shaft 31 that transfers the rotational drive force from the motor 2 to the top mechanism 3. Motor support bracket mounts 146 are mounted in the cantilever support 7 for attaching the motor supporting brackets 33 that fixedly support the motor 2. Further, the interior of the bed 8 is provided with a pair of lower conducting shaft supports 147, 147 for rotatably supporting the rotary hook shaft 37 that transfer the rotational drive force from the motor 2 to the lower mechanism 4, and a lower frame mount 148 on which the lower frame 20 is mounted.

Reinforcing Member

Referring to FIGS. 4 and 5, a reinforcing member 60 is provided around the inner surface wall 51 of the main frame 1A facing the space 9 surrounded the arm 6, cantilever support 7, and bed 8. The reinforcing member 60 is formed integrally with the back panel wall 250. One end of the reinforcing member 60 extends along the longitudinal direction of the arm 6 to the point adjacent to the side wall 251 at one end of the arm 6 opposing the cantilever support 7. The other end of the reinforcing member 60 extends along the longitudinal direction of the bed 8 to the point adjacent to the side wall 251 at one end of the bed 8 opposing the bed 8. As described above, the reinforcing member 60 comprises three parts: one part placed around the inner surface wall 51 in a semicircle shape, another part placed in a linear manner as if it crosses the arm 6, and the other part placed in a linear manner as if it crosses the bed 8. Accordingly, the reinforcing member 60 is placed in a continuous manner to form a U-shape as a whole. The above structure of the reinforcing member 60 reinforces projecting portions of the arm 6 and the bed 8 which extend from the cantilever support 7.

Referring to FIG. 8(D), the reinforcing member 60 has a tubular shape with a hollow circular cross-section. This reinforcing member 60 is formed with the back panel wall 250 integrally to project from the inner surface of the back panel wall 250. The reinforcing member 60 is formed in a tubular shape for the following reasons. As described above, the main frame 1A is formed according to an injection molding method. In this method, after injecting a molten resinous material in a cavity die shell, the resinous material is cooled. At this time, thicker portions of the molded product harden slower than thinner portions. Since contraction is greater at the thicker portions, shrinkage occurs in those portions. In order to prevent such shrinkage, it is necessary to maintain a uniform thickness in the molded product. For this reason, the reinforcing member 60 is formed in a hollow tubular shape. When forming the frame 1, the tubular shape of the reinforcing member 60 is formed by injecting an inert fluid, such as argon gas or nitrogen gas, through an injection hole 61 formed at one end of the reinforcing member 60 adjacent to the side wall 251, and subsequently cooling the reinforcing member 60.

The above structure of the reinforcing member 60 ensures the rigidity of the inner surface wall 51 facing the space 9 surrounded by the arm 6, the cantilever support 7, and the bed 8 on which stress caused by the reciprocating motion of the needle 16 is concentrated. The above structure of the reinforcing member 60 also ensures the rigidity of the back panel wall 250 and the side wall 251 of the arm 6, cantilever support 7, and bed 8 adjacent to the inner surface wall 51. Accordingly, a sewing machine including the main frame 1A prevents horizontal and vertical vibrations of the main frame 1A caused by the reciprocating motion of the needle 16, thereby performing a smooth stitch forming action.

In addition, the reinforcing member 60 has a semicircle hollow section to achieve a light weight and provide sufficient rigidity. The reinforcing member 60 is formed integrally with the back panel wall 250. Accordingly, process for manufacturing the main frame 1A is simplified.

In the embodiment described above, the reinforcing member 60 has one end extending to the point adjacent to the side wall 251 placed at the tip of the arm 6, and the other end extending to the point adjacent to the side wall 251 placed at the tip of the bed 8. In another embodiment, the reinforcing member 60 may extend to a certain point between the arm 6 and the bed 8. It is preferable that the reinforcing member 60 is provided around at least the space 9. In this case, the arrangement of the reinforcing member 60 may have a J-shape, C-shape, or a rectangular shape with one open side.

Auxiliary Reinforcing Member

Referring to FIGS. 4 and 5, the back panel wall 250 of the main frame 1A has an auxiliary reinforcing member 66 formed integrally therewith. The auxiliary reinforcing member 66 is placed substantially parallel to the reinforcing member 60 outside thereof at a predetermined interval. The auxiliary reinforcing member 66 is placed in a continuous manner described as follows: The auxiliary reinforcing member 66 extends from a certain point between the cantilever support 7 and the side wall 251 at the arm 6 along the longitudinal direction of the arm 6 within the arm 6 to one end of the cantilever support 7. The auxiliary reinforcing member 66 is then curved in a semicircle shape within the cantilever support 7 to extend to one end of the bed 8. The auxiliary reinforcing member 66 further extends from the one end of the cantilever support 7 along the bed 8 with in the bed 8 to the point adjacent to the side wall 251 opposing to the cantilever support 7. As describe above, the parallel arrangement of the reinforcing member 60 and the auxiliary reinforcing member 66 leads to a uniform filling to the interior of the back panel wall 250 between the reinforcing member 60 and the auxiliary reinforcing member 66 with synthetic resin, thereby preventing weld line and shrinkage appearing on the back panel wall 250. As a result, the main frame 1A can obtain a good appearance.

Referring to FIG. 7(*c*), the auxiliary reinforcing member 66 has the substantially semicircle cross section similar to that of the reinforcing member 60. The auxiliary reinforcing member 66 has a hollow tubular shape having a hollow space 68 within the auxiliary reinforcing member 66. The auxiliary reinforcing member 66 is formed integrally with the back panel wall 250 in a manner to project from the interior of the back panel wall 250 of the main frame 1A. The reason why the auxiliary reinforcing member 66 has a tubular shape is the same as that of the reinforcing member 60. Additionally, a method to form the auxiliary reinforcing member 66 is the same as that of the reinforcing member 60.

The above arrangement of the auxiliary reinforcing member 66 ensures the rigidity of the back panel wall 250. Therefore, a sewing machine including the above main frame 1A can advantageously prevent horizontal and vertical vibrations of the main frame 1A caused by the reciprocating motion of the needle 16, thereby performing smooth stitch forming action In the above embodiment, the main frame 1A is provided with the reinforcing member 60 and the auxiliary reinforcing member 66, while the frame cover 1B does not has any reinforcing member and auxiliary reinforcing member (See FIG. 11). The reason why frame cover 1B has no reinforcing member is as follows: the main frame 1A accommodates the stitch forming mechanism including the tope mechanism 3 for reciprocating the needle 16 and the lower mechanism 4 for rotating the rotary hook 23. Therefore, vibrations or displacement are more easily induced to the main frame 1A than the frame cover 1B. However, the frame cover 1B may be provided with a reinforcing member or an auxiliary reinforcing member, if necessary. In that case, the frame cover 1B obtains stronger rigidity.

Inside Wall Reinforcing Rib

As shown in FIGS. 4 and 5, an inside wall reinforcing rib 70 for reinforcing the inner surface wall 51 of the main frame 1A facing the space 9 is provided on the inside of the back panel wall 250 around the periphery of the space 9. A lot of inside wall reinforcing ribs 70 are provided around the periphery of the space 9 from the joint of the arm 6 and the cantilever support 7 to the joint of the cantilever support 7 and the bed 8.

The inside wall reinforcing rib 70 comprises a partitioning rib 71 spaced from the inner surface 51 and a plurality of intermediate ribs 72 intersecting with the inner surface 51 and partitioning rib 71. The partitioning rib 71 extends from the inside of the back panel wall 250 and parallel and perpendicularly to the inner surface wall 51 in a continuous manner. The intermediate rib 72 extends from the inside of the back panel wall 250 between the inner surface wall 51 and the partitioning rib 71 at a constant intervals perpendicularly to the back panel wall 250. The intermediate rib 72 connects the inner surface wall 51 to the partitioning rib 71, and connects the inner surface wall 51 and the partitioning rib 71 to the back panel wall 250. The above arrangement of the inner surface wall 51, the partitioning rib 71, and the intermediate ribs 72 provides a plurality of cells 73 in the space between the inner surface 51 and partitioning rib 71. The intermediate ribs 72 are arranged radially from a center point located in the space 9, because the inner surface wall 51 surrounding the space 9 has a semicircle shape. Accordingly, each intermediate rib 72 intersects the inner surface 51 and partitioning rib 71 at a perpendicular angle. Thus, the arrangement of the ribs is optimized, thereby reinforcing the inner surface wall 51 advantageously.

The above structure of the inside wall reinforcing ribs 70 provides the rigidity equal to that of the inner surface wall 51 having a considerable thickness. In other words, the above structure of the inside wall reinforcing ribs 70 ensures the rigidity over the back panel wall 250 from the area adjacent to the joint of the arm 6 and the cantilever support 7, through the cantilever support 7, to the area adjacent to the joint of the cantilever support 7 and the bed 8. A sewing machine having the main frame 1A can prevent horizontal and vertical vibrations of the main frame 1A caused by the reciprocating motion of the needle 16, thereby performing a smooth stitch forming action.

In the above embodiment, the inside wall reinforcing ribs 70 are provided on the back panel wall 250 from the joint of the arm 6 and the cantilever support 7 through the 7 through the 7 to the joint of the cantilever support 7 and the bed 8. In another embodiment, the inside wall reinforcing rib 70 may be formed over the whole of the inner surface wall 51. In the above embodiment, a lot of intermediate ribs 72 are provided. However, in another embodiment, the number of the intermediate ribs 72 may be only one or a few. Each of the intermediate ribs 72 may be coupled or crossed to each other, so that the resultant arrangement of the intermediate ribs 72 may have honeycomb or diagram shape.

As described above, the hollow reinforcing member 60 having a substantially semicircle shape is formed integrally with the back panel wall 250 around the inner surface wall 51. In other words, both the reinforcing member 60 and the inside wall reinforcing rib 70 are formed at the substantially same positions on the inner surface wall 51. Especially, the reinforcing member 60 is located near the back panel wall 250 inside of the inside wall reinforcing rib 70. The inside wall reinforcing rib 70 projects from the surface of the reinforcing member 60. The above structure is necessary to obtain considerable reinforcement, because stress induced by the reciprocating motion of the needle 16 is concentrated on the inner surface wall 51. In addition, the space around the inner surface wall 51 has sufficient spare room because the stitch forming mechanism is not mounted. Therefore, the inside wall reinforcing rib 70 having a considerable height can be formed.

Outside Wall Reinforcing Rib

As shown in FIGS. 4 and 5, outside wall reinforcing ribs 80 are formed in a matrix shape over nearly the entire inside of the back panel wall 250. The outside wall reinforcing rib 80 projects from the inside of the back panel wall 250. The outside wall reinforcing rib 80 is formed of vertical ribs 81 vertically oriented when the sewing machine is placed on a working surface, and horizontal ribs 82 oriented horizontally when the sewing machine is in the same position. As shown in FIGS. 6(A) and 6(B), these vertical ribs 81 and horizontal ribs 82 are approximately perpendicular to the back panel wall 250. The ends of the vertical ribs 81 and horizontal ribs 82 are joined with the side wall 251 on the side portions of the main frame 1A. The spaces surrounded by pairs of intersecting vertical ribs 81, 81 and horizontal ribs 82, 82 form approximately square or rectangular shaped cells 83. Hence, a plurality of cells 83 are formed on the back side of the back panel wall 250.

Among the cells 83, the outside wall reinforcing rib 80 defining a cell 83 having a wider area is formed to have a higher height from the back panel wall 250, compared to a cell 83 having a narrower area. The above structure of the cell 83 will be explained with respect to a wider cell 83A located on the right side of the arm conducting shaft supports 144 in the cantilever support 7 (see FIGS. 4 and 5), and a narrower cell 83B located on the lower-right side of the needle bar holder mount 141 in the arm 6 (see FIGS. 4 and 5).

As shown in FIG. 5, the vertical length X of the wider cell 83A is identical to the vertical length U of the narrower cell 83B. On the other hand, the horizontal length Y of the wider cell 83A is longer more than two times of the horizontal length V of the narrower cell 83B. Thus, the area of the wider cell 83A is wider than that of the narrower cell 83B.

Referring to FIG. 6(A), the height Z from the 250 of the outside wall reinforcing rib 80 constituting the wider cell 83A (horizontal rib 82) is higher than the height W from the back panel wall 250 of the outside wall reinforcing rib 80 constituting the narrower cell 83B (vertical rib 81). In the case where the outside wall reinforcing ribs 80 have different height from each other due to requirements for a design of the main frame 1A, the wider area of the higher outside wall reinforcing rib 80 and the narrower area of the narrower outside wall reinforcing rib 80 lead to the uniform rigidity over the whole of the back panel wall 250. Accordingly, the action of stress on the particular point on the back panel wall 250 can be avoided. Thus, the main frame 1A ensures considerable rigidity as a whole.

The outside wall reinforcing rib 80 on the accommodating part for the stitch forming mechanism in the arm 6 or the bed 8 has a lower height from the back panel wall 250 than those of the outside wall reinforcing ribs 80 on the inside of the back panel wall 250 other than the accommodating part. In other words, as described above, the narrower cell 83B is located on the right-lower side of the needle bar holder mount 141 for mounting the needle bar holder 14 constituting the tope mechanism 3, thereby corresponding to the part accommodating the stitch forming mechanism. Therefore, the outside wall reinforcing rib 80 (vertical rib 81) has a relatively lower height W from the back panel wall 250 so as to face the stitch forming mechanism at a closer distance. On the other hand, the wider cell 83A is not a part for accommodating the stitch forming mechanism. Accordingly, as described above, the outside wall reinforcing rib 80 (horizontal rib 82) has a relatively higher height Z form the back panel wall 250. However, the above structure may lead to insufficient rigidity over the part for accommodating the stitch forming mechanism. To overcome the above problem, the narrower area of the cell 83, that is, the formation of the narrower cell 83B, results in the increase of the rigidity thereof. The resultant rigidity is substantially the same as that of the wider cell 83A. Accordingly, the concentration of stress to a certain point of the back panel wall 250 can be prevented, so that the main frame 1A can obtain sufficient rigidity.

The above arrangement of the outside wall reinforcing rib 80 ensures the sufficient rigidity of the back panel wall 250, thereby minimizing or restricting distortion appearing on the back panel wall 250 of the arm 6 due to the reciprocating motion of the needle 16. The above arrangement of the outside wall reinforcing rib 80 also minimizes distortion appearing on the back panel wall 250 of the cantilever support 7 and the bed 8 due to the distortion of the arm 6. In this embodiment, the outside wall reinforcing ribs 80 extend in vertical and horizontal directions on the back panel wall 250 to define the cells 83. This arrangement results in the sufficient rigidity of the back panel wall 250 in the case where the outside wall reinforcing rib 80 is not allowed to have a higher height in order that the main frame 1A accommodates the stitch forming mechanism. Accordingly, a sewing machine having the above main frame 1A can prevent vertical and horizontal vibrations of the main frame 1A caused by the reciprocating motion of the needle 16, thereby performing a smooth stitch forming action.

In another embodiment, the outside wall reinforcing rib 80 may not be formed over the whole back panel wall 250, but be formed over only the part of the back panel wall 250 which needs sufficient rigidity of the back panel wall 250 for accommodating the stitch forming mechanism. In another embodiment, the outside wall reinforcing ribs 80 may be arranged in order that the cells 83 have hexagonal or octagonal shapes.

It should be noted that the inside wall reinforcing rib 70 has a higher height from the back panel wall 250 than that of the outside wall reinforcing rib 80. More specifically, as shown in FIG. 8(A), at the base end of the arm 6, the inside wall reinforcing rib 70 is formed at a height from the back panel wall 250 reaching the dividing plane 52. In contrast, the vertical ribs 81 reach approximately halfway to the dividing plane 52 from the back panel wall 250. As shown in FIG. 8(B), in the center portion of the cantilever support 7, the intermediate ribs 72 have a height from the sidewall 50 reaching the dividing plane 52. In contrast, the horizontal ribs 82 reach less than half the height of the dividing plane 52 from the sidewall 50. A high rigidity is necessary for the inner surface wall 51 since stress generated by the vertical movement of the needle 16 is concentrated in this area. On the other hand, these height differences are necessary to maintain space at the inside of the back panel wall 250 for accommodating the stitch forming mechanism including the top mechanism 3 and the lower mechanism 4.

Couplings

As shown in FIGS. 4 and 5, a plurality of couplings 90, 92, 94, and 96 are provided in the back panel wall 250 of the main frame 1A for joining the main frame 1A to the frame cover 1B. The coupling 90 is formed near the inner surface wall 51 in the area adjacent to the joint of the bed 8 and the cantilever support 7. More specially, the coupling 90 is placed in the vicinity of the inside wall reinforcing rib 70 and the reinforcing member 60. The above arrangement of the coupling 90 is aimed at preventing distortion of the arm 6 and the cantilever support 7 which causes swings of the top portion of the cantilever support 7 during the reciprocating motion of the needle 16. The coupling 92 is formed near the inner surface wall 51 at the joint area of the arm 6 and the cantilever support 7. More particularly, the coupling 92 is placed in the vicinity of the inside wall reinforcing rib 70 and the reinforcing member 60. The coupling 94 is formed near the inner surface wall 51 in the vicinity of the end of the inside wall reinforcing rib 70 near the arm 6. The couplings 92, 94 are placed on the circumference of the semicircle of the space 9 at constant intervals with respect to the coupling 90. A plurality of couplings 96 are formed on the sides and the corners of the inside of the back panel wall 250 in order to couple the main frame 1A and the frame cover 1B by a uniform pressure.

Screw holes 91, 93, 95, and 97 are formed inside the couplings 90, 92, 94, and 96. The main frame 1A and frame cover 1B can be detachably joined together by inserting screws (not shown) in the screw holes 91, 93, 95, and 97 when the couplings 90, 92, 94, and 96 are aligned with couplings 190, 192, 194, and 196 (see FIG. 11) provided in corresponding positions on the frame cover 1B. Accordingly, the sewing machine is easily assembled by mounting the stitch forming mechanism to the main frame 1A, and then screwing the frame cover 1B to the main frame 1A, thereby enabling cost reductions. In the case of maintenance, only undoing the screws leads to remove of the frame cover 1B from the main frame 1A, so that all the stitch forming mechanism is exposed. Therefore, the maintenance work is facilitated. In the present embodiment, screws are used to join the main frame 1A to the frame cover 1B, but bolts and nuts may also be used in place of the screws.

When stress induced by the reciprocating motion of the needle 16 forces the inner surface wall 51 of the main frame 1A and an inner surface wall 161 of the frame cover 1B to relatively move in a vertical or horizontal directions, relative movement of the main frame 1A and the frame cover 1B is restricted because a plurality of couplings 190, 192, and 194 (see FIG. 11) are arranged around the inner surface walls 51, 161. Therefore, the inner surface wall 51 of the main frame 1A remains contact with the inner surface wall 161 of the frame cover 1B. A appropriate coupling between the main frame 1A and the frame cover 1B is maintained. Stress is transmitted from the main frame 1A including the stitch forming mechanism which generates vibrations to the frame cover 1B through the inner surface walls 51, 161 which are contact to each other, thereby dispersing over the whole frame 1. The stress dispersion ensures the sufficient rigidity of the frame 1. As a result, a sewing machine including the frame 1 can prevent vertical vibrations and horizontal swings of the frame 1 induced by the reciprocating motion of the needle 16, thereby performing a smooth stitch forming action.

In another embodiment, two or more than four couplings may be formed around the inner surface wall 51 of the main frame 1A.

Protrusions

As shown in FIG. 4, protrusions 100, 101, 102, and 103 are formed on the main frame 1A at the dividing plane 52. These protrusions 100, 101, 102, and 103 engage with engaging units 111, 112, 113, and 114 provided on the frame cover 1B at the dividing plane 52 (see FIG. 11) when the main frame 1A is joined with the frame cover 1B. The protrusions 100, 101, 102, and 103 are aimed at limiting the relative movement of the main frame 1A and frame cover 1B in the horizontal direction.

Next, the reason that the sewing machine frame of the present invention is configured in this way will be described. As mentioned earlier, a swing effect occurs in the horizontal direction in the top portion of the cantilever support 7 due to the vertical movement of the needle 16. When this happens, the main frame 1A and frame cover 1B can move relative to one another in the horizontal direction, shifting their relative positions. When this positional shifting occurs, a reliable joined state cannot be maintained, resulting in insufficient rigidity, thereby promoting vibrations and displacement in the frame 1. Moreover, the main frame 1A and frame cover 1B are joined by screws through considerable pressure, causing a large frictional coefficient. As a result, when the relative position of the main frame 1A and frame cover 1B shifts, they do not easily return to their original positions. The above construction is employed because it is necessary to prevent such shifting in the relative position of the main frame 1A and frame cover 1B from occurring. With this construction, it is possible to maintain sufficient rigidity in the frame 1.

As shown in FIG. 9(A), the protrusion 100 protrudes from the bottom of the arm 6 at the dividing plane 52 substantially perpendicular to the frame cover 1B and near the border between the horizontal portion on which the mechanism for reciprocally driving the needle 16 is supported and the semicircular portion by which the space 9 is formed. An opening 143 is formed in the front end of the arm 6 from which the reciprocally driving mechanism protrudes downward. The protrusion 100 is positioned to one side of the opening 143. The protrusion 100 fits in the engaging unit 111 provided on the arm 6 of the frame cover 1B (see FIG. 11). This configuration prevents relative movement of the main frame 1A and frame cover 1B generated by vibrations and displacement at the dividing plane 52 of arm 6.

As shown in FIG. 9(B), the protrusions 101 and 102 protrude from the top of the bed 8 at the dividing plane 52, that is, at both ends of an opening 149 approximately perpendicular to the frame cover 1B. The opening 149 is aimed for exposing rotary hook 23. The protrusions 101, 102 are fitted into engaging units 112, 113 provided in the bed 8 of the frame cover 1B (see FIG. 11). The above arrangement can prevent relative movement of both the main frame 1A and the frame cover 1B caused by vibrations and displacement at the dividing plane 52 of the bed 8 in the main frame 1A and the frame cover 1B.

Referring to FIGS. 8(B), 8(C), the protrusion 103 protrudes to the frame cover 1B being coupled at a predetermined point on the dividing plane 52 around the space 9. The predetermined point is placed on the intermediate rib 72 constituting the inside wall reinforcing rib 70 in the vicinity of a cross point with the inner surface wall 51 around the space 9. The protrusion 103 fits a channel-shaped engaging unit 114 (see FIG. 11) provided the periphery of the frame cover 1B facing the space 9. The above structure prevents vibrations and displacement at the dividing plane 52 around space 9, thereby restricting relative movement of the coupled main frame 1A and frame cover 1B.

Referring to FIG. 9(A), an engaging unit 110 for receiving the protrusion 104 (see FIG. 11) protruding from the dividing plane 52 below the arm 6 of the frame cover 1B. The place of the engaging unit 110 is on the dividing plane 52 below the arm 6 of the main frame 1A. The above arrangement prevents vibrations and displacement at the dividing plane 52 of the arm 6 of the coupled main frame 1A and frame cover 1B, thereby restricting relative movement of the main frame 1A and frame cover 1B.

Top Edge

As shown in FIGS. 4 and 7(A), a top edge 120 is formed across the top of the main frame 1A for contacting the frame cover 1B. A raised step 121 is formed across nearly the entire top edge 120, the bottom of raised step 121 protruding toward the frame cover 1B. The protruding portion of the raised step 121 fits into a recessed step 126 formed in a top edge 125 of the frame cover 1B for contacting the main frame 1A (see FIG. 11). By engaging the raised step 121 with the recessed step 126 from above, this construction can limit the relative movement of the main frame 1A in the upward direction.

Next, the reason that the sewing machine frame of the present invention is configured in this way will be described. As mentioned earlier, the portion of the main frame 1A near the arm 6 vibrates in the vertical direction due to the vertical movement of the needle 16. In particular, the main frame 1A on which the top mechanism 3 is mounted for supporting the needle 16 tends to move in the upward direction. When this happens, the main frame 1A and frame cover 1B can move relative to one another in the vertical direction, shifting their relative positions. When this positional shifting occurs, a reliable joined state cannot be maintained, resulting in insufficient rigidity, thereby promoting vibrations and displacement in the frame 1. Moreover, the main frame 1A and frame cover 1B are joined by screws through considerable pressure, causing a large frictional coefficient. As a result, when the relative position of the main frame 1A and frame cover 1B shifts, they do not easily return to their original positions. The above construction is employed because it is necessary to prevent such shifting in the relative position of the main frame 1A and frame cover 1B from occurring. With this construction, it is possible to maintain sufficient rigidity in the frame 1.

While the raised step 121 in the present embodiment is formed across nearly the entire length of the top edge 120 of the main frame 1A that contacts the frame cover 1B, it is not necessary for the raised step 121 to span the entire length of the top edge 120. In view of the reason described above for forming the raised step 121, however, it is desirable that the raised step 121 be formed on the top edge 120 at least at portions of the main frame 1A corresponding to the arm 6. Similarly, the recessed step 126 (see FIG. 11) should be formed on the top edge 125 at least on portions of the frame cover 1B that correspond to the arm 6. With this construction, it is possible to achieve sufficient rigidity for the arm 6.

A bottom edge 130 is formed across the bottom of the main frame 1A for contacting the frame cover 1B. A raised step 131 is formed across nearly the entire length of the bottom edge 130, the top of the raised step 131 protruding toward the frame cover 1B. As shown in FIG. 7(B), the raised step 131 comprises an insertion part 132 for inserting into a recessed step 136 (see FIG. 11) formed on a bottom edge 135 of the frame cover 1B for contacting the main frame 1A; a sliding surface 133 for guiding the raised step 131 into the recessed step 136; and an engaging wall 134 for engaging in the recessed step 136 after the recessed step 136 has been slid to a prescribed position. By inserting the insertion part 132 in the recessed step 136 of the frame cover 1B and engaging the sliding surface 133 with the bottom of the recessed step 136, it is possible to limit relative movement of the main frame 1A in the downward direction.

Next, the reason that the sewing machine frame of the present invention is configured in this way will be described. As mentioned earlier, the portion of the main frame 1A tends to move upward due to the vertical movement of the needle 16. When this happens, the bed 8 of the frame cover 1B engaged with the main frame 1A attempts to move downward relative to the main frame 1A. As a result, the frame cover 1B shifts vertically from the main frame 1A, promoting the generation of vibrations and displacement in the frame 1. Hence, it is necessary to prevent such shifting in the relative position of the main frame 1A and frame cover 1B from occurring. With this construction, it is possible to maintain sufficient rigidity in the frame 1.

While the raised step 131 in the present embodiment is formed across nearly the entire length of the bottom edge 130 of the main frame 1A that contacts the frame cover 1B, it is not necessary for the raised step 131 to span the entire length of the bottom edge 130. In view of the reason described above for forming the raised step 131, however, it is desirable that the raised step 131 be formed on the bottom edge 130 at least at portions of the main frame 1A corresponding to the bed 8. Similarly, the recessed step 136 (see FIG. 11) should be formed on the bottom edge 135 at least on portions of the frame cover 1B that correspond to the bed 8. With this construction, it is possible to achieve sufficient rigidity for the bed 8.

Here, the sliding surface 133 of the raised step 131 is retracted further internally than the back panel wall 250 of the main frame 1A. When the recessed step 136 of the frame cover 1B overlaps this portion, the sidewall of the main frame 1A and frame cover 1B become the same height. Accordingly, by engaging the main frame 1A with the frame cover 1B, the sidewall of the main frame 1A and frame cover 1B forms a continuous surface at this point, improving the appearance of the frame 1.

While a detailed construction of the raised step 121 described above is not shown in the drawings, this construction is similar to the raised step 131 of the bottom edge 130 shown in FIG. 7(B). However, the raised step 121 is vertically symmetrical to the raised step 131.

Flame Cover

Figure 10:
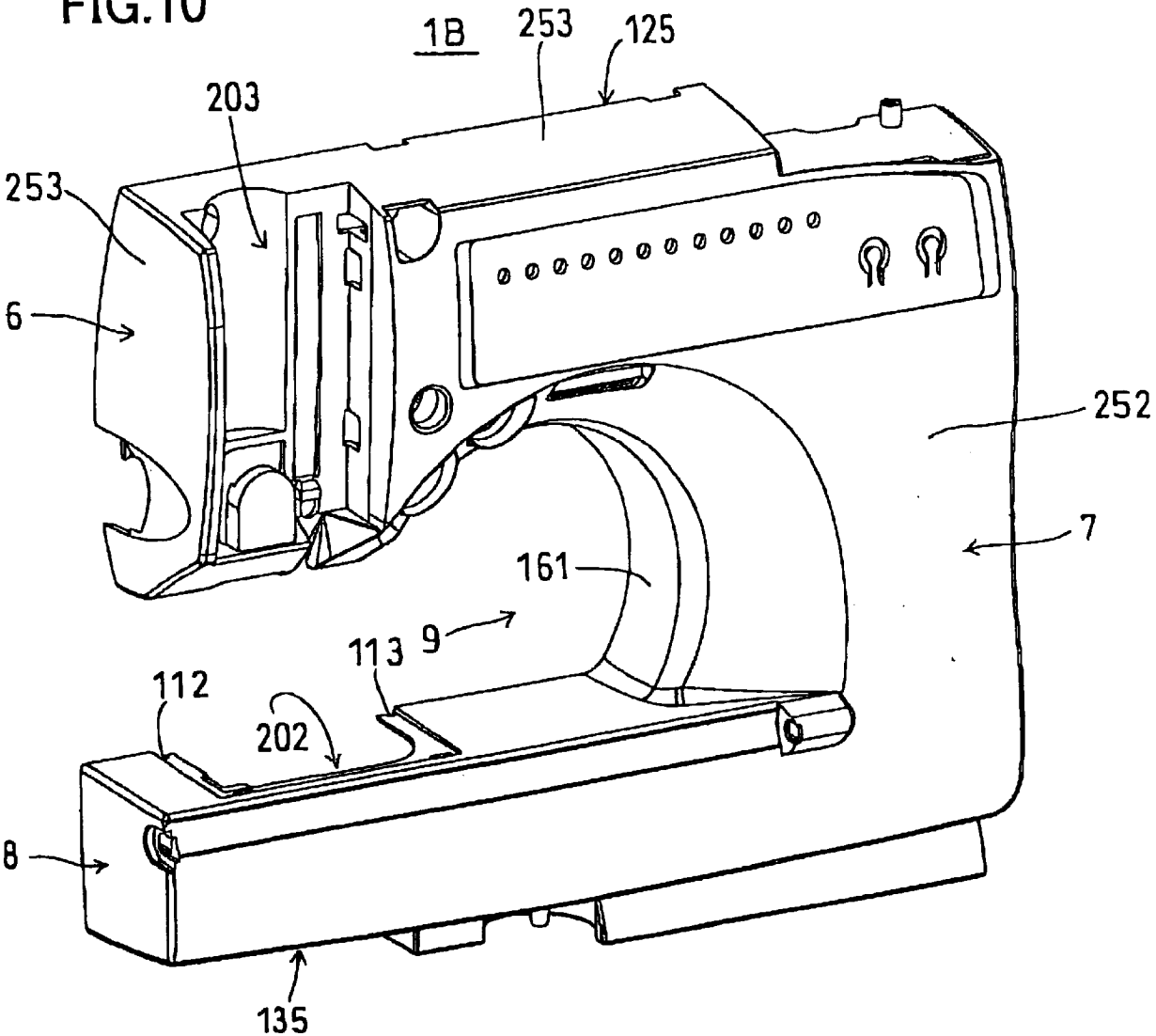
FIG. 10 is a perspective view showing the external appearance of the frame cover.
Figure 12:
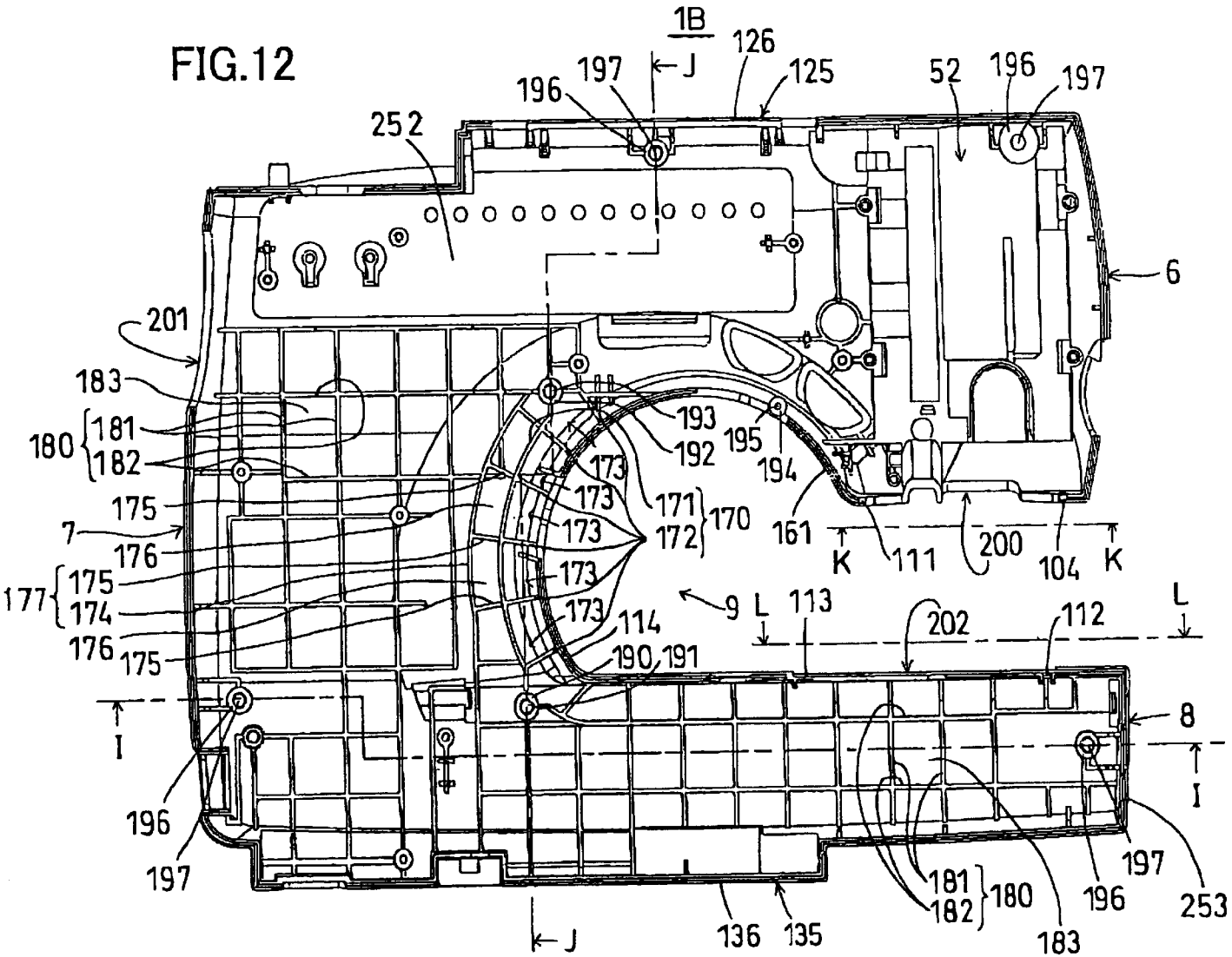
FIG. 12 is a plan view showing the internal construction of the frame cover.
Figure 13:
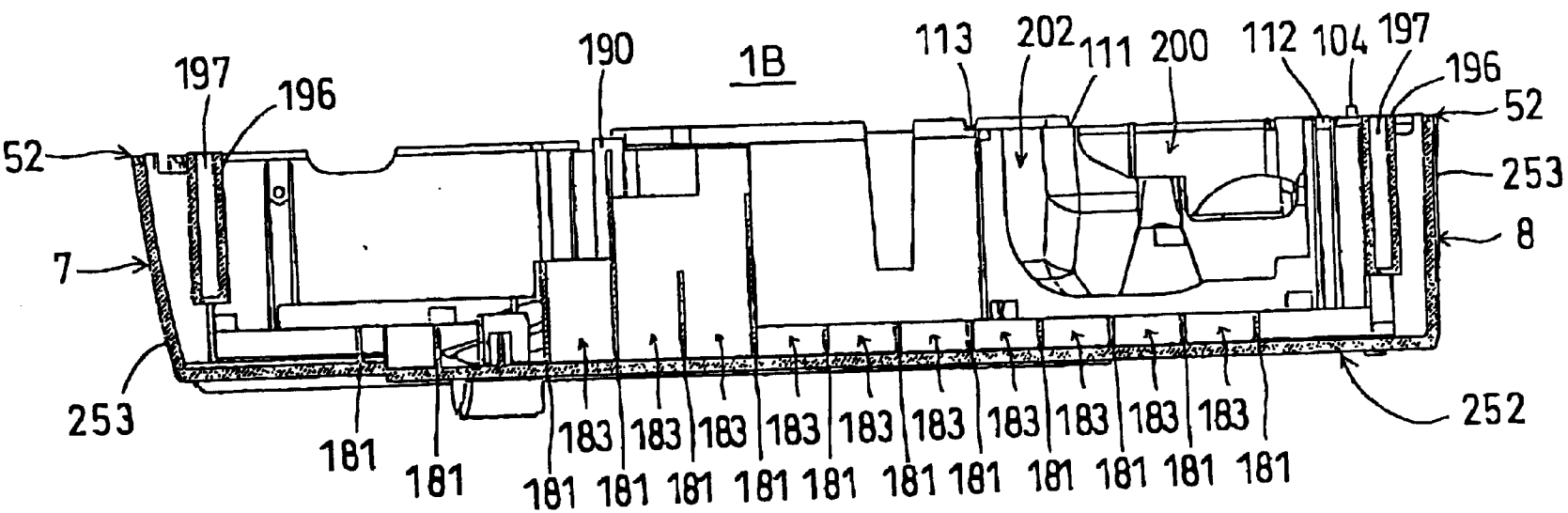
FIG. 13 is a cross-sectional view along the plane of the frame cover indicated by the arrows I in FIG. 12.
Figure 14A:
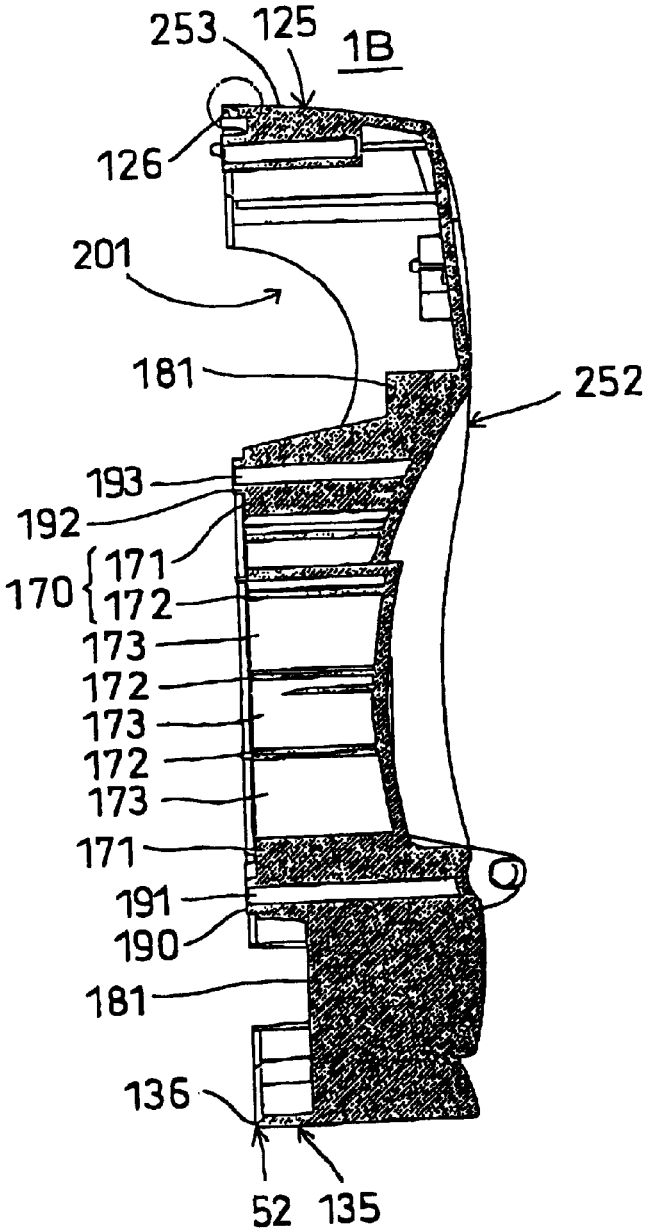
FIG. 14(A) is a cross-sectional view along the plane of the frame cover indicated by the arrows J in FIG. 12.
Figure 14B:
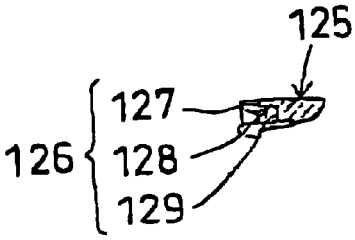
FIG. 14(B) is an enlarged view showing the lower end of the frame cover.
Figure 15A:
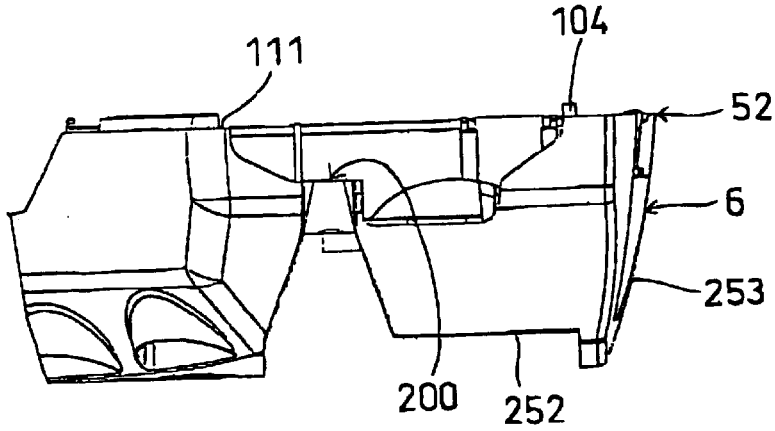
FIG. 15(A) is an enlarged plan view along the plane of the frame cover indicated by the arrows K in FIG. 12.
Figure 15B:
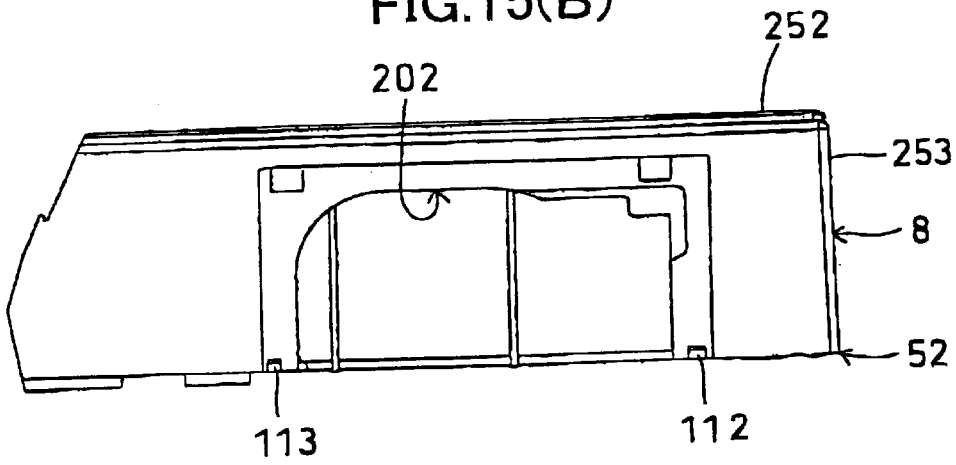
FIG. 15(B) is an enlarged plan view along the plane of the frame cover indicated by the arrows L in FIG. 12.
Figure 16:
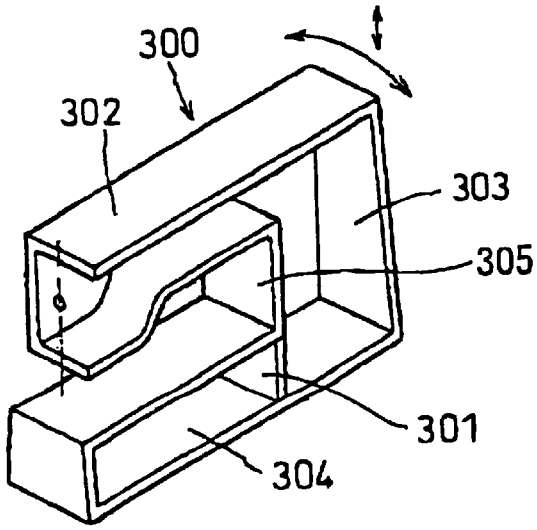
FIG. 16 is a perspective view showing a conventional sewing machine frame.

Next, the frame cover 1B of the frame 1 will be described with reference to FIG. 10 through needle bar 15. FIG. 10 is a perspective view showing the external appearance of the frame cover 1B. FIG. 11 is a perspective view showing the internal construction of the frame cover 1B. FIG. 12 is a plan view showing the internal construction of the frame cover 1B. FIG. 13 is a cross-sectional view along the plane of the frame cover 1B indicated by the arrows I in FIG. 12. FIG. 14(A) is a cross-sectional view along the plane of the frame cover 1B indicated by the arrows J in FIG. 12. FIG. 14(B) is an enlarged view showing the lower end of the frame cover 1B. FIG. 15(A) is an enlarged plan view along the plane of the frame cover 1B indicated by the arrows K in FIG. 12. FIG. 15(B) is an enlarged plan view along the plane of the frame cover 1B indicated by the arrows L in FIG. 12.

As shown in FIG. 10, the frame cover 1B comprises the arm 6, cantilever support 7, and bed 8, and is integrally formed of a synthetic resin with the arm 6, cantilever support 7, and bed 8. The semicircular area surrounded by the arm 6, cantilever support 7, and bed 8 is the space 9 the main frame 1A substantially comprises the arm 6, the cantilever support 7, and the bed 8 formed integrally. The semicircular space surrounded by the arm 6, cantilever support 7, and bed 8 is a space 9.

In addition, the frame cover 1B comprises a front panel wall 252 constituting a front side of the sewing machine, and side wall 253 extending from a peripheral edge 252*a* of the front panel wall 252. Especially, the surface of the frame cover 1B facing the space 9 is designated as an inner surface wall 161. A side portion of the arm 6 is provided with a thread cassette mount 203 in which a thread cassette including different kinds of thread.

Inside Wall Reinforcing Rib

As shown in FIGS. 11 and 12, an inside wall reinforcing rib 170 for reinforcing the inner surface wall 161 of the frame cover 1B facing the space 9 is provided on the inside of the front panel wall 252 around the periphery of the space 9. A lot of inside wall reinforcing ribs 170 are provided around the periphery of the space 9 from the joint of the arm 6 and the cantilever support 7 to the joint of the cantilever support 7 and the bed 8 in order to surround the inner surface wall 161.

The inside wall reinforcing rib 170 comprises a partitioning rib 171 spaced from the inner surface 161 and a plurality of intermediate ribs 172 intersecting with the inner surface 161 and partitioning rib 171. The partitioning rib 171 extends from the inside of the front panel wall 252 and parallel and perpendicularly to the inner surface wall 161 in a continuous manner. The intermediate rib 172 extends from the inside of the front panel wall 252 between the inner surface wall 161 and the partitioning rib 171 at a constant intervals perpendicularly to the front panel wall 252. The intermediate rib 172 connects the inner surface wall 161 to the partitioning rib 171, and connects the inner surface wall 161 and the partitioning rib 171 to the front panel wall 252. The above arrangement of the inner surface wall 161, the partitioning rib 171, and the intermediate ribs 172 provides a plurality of cells 173 in the space between the inner surface 161 and partitioning rib 171. The intermediate ribs 172 are arranged radially from a center point located in the space 9, because the inner surface wall 161 surrounding the space 9 has a semicircle shape. Accordingly, each intermediate rib 172 intersects the inner surface 161 and partitioning rib 171 at a perpendicular angle. Thus, the arrangement of the ribs is optimized, thereby reinforcing the inner surface wall 161 advantageously.

The above structure of the inside wall reinforcing ribs 170 provides the rigidity equal to that of the inner surface wall 161 having a considerable thickness. In other words, the above structure of the inside wall reinforcing ribs 170 ensures the rigidity over the front panel wall 252 from the area adjacent to the joint of the arm 6 and the cantilever support 7, through the cantilever support 7, to the area adjacent to the joint of the cantilever support 7 and the bed 8. A sewing machine having the frame cover 1B can prevent horizontal vibrations and swings of the frame cover 1B caused by the reciprocating motion of the needle 16, thereby performing a smooth stitch forming action.

In the above embodiment, the inside wall reinforcing ribs 170 are provided on the front panel wall 252 from the joint of the arm 6 and the cantilever support 7 through the 7 through the 7 to the joint of the cantilever support 7 and the bed 8. In another embodiment, the inside wall reinforcing rib 170 may be formed over the whole of the inner surface wall 161. In the above embodiment, a lot of intermediate ribs 172 are provided. However, in another embodiment, the number of the intermediate ribs 172 may be only one or a few. Each of the intermediate ribs 172 may be coupled or crossed to each other, so that the resultant arrangement of the intermediate ribs 172 may have a honeycomb or diagram shape.

In order to further support the partitioning rib 171 of the inside wall reinforcing ribs 170, a supplemental concave wall reinforcing rib 177 is provided outside of the inside wall reinforcing ribs 170. The supplemental concave wall reinforcing rib 177 comprises an auxiliary partitioning rib 174 and a plurality of auxiliary intermediate ribs 175. The auxiliary partitioning rib 174 is provided in a continuous manner along the partitioning rib 171, while being spaced from the partitioning rib 171. The auxiliary intermediate ribs 175 intersect the partitioning rib 171 and partitioning rib 174 at predetermined intervals, and form a plurality of cells or compartments 176 between the partitioning rib 171 and partitioning rib 174. This construction attains further rigidity of the inner surface 161 of the space 9. In another embodiment, supplemental concave wall reinforcing ribs may be provided outside of the inside wall reinforcing rib 70 of the main frame 1A, if the main frame 1A has sufficient spare space.

Outside Wall Reinforcing Rib

As shown in FIGS. 11 and 12, outside wall reinforcing ribs 180 are formed in a matrix shape over nearly the entire inside of the front panel wall 252. The outside wall reinforcing rib 180 projects from the inside of the front panel wall 252. The outside wall reinforcing rib 180 is formed of vertical ribs 181 vertically oriented when the sewing machine is placed on a working surface, and horizontal ribs 182 oriented horizontally when the sewing machine is in the same position. As shown in FIGS. 13 and 14(A), these vertical ribs 181 and horizontal ribs 182 are approximately perpendicular to the front panel wall 252. The ends of the vertical ribs 181 and horizontal ribs 182 are joined with the side wall 253 on the side portions of the frame cover 1B. The upper ends of the vertical ribs 181 are not coupled to the side wall 253. This is because the upper portion of the frame cover 1B needs sufficient space to accommodate thread cassettes and an LED display substrate. The spaces surrounded by pairs of intersecting vertical ribs 181, 181 and horizontal ribs 182, 182 form approximately square or rectangular shaped cells 183. Hence, a plurality of cells 183 are formed on the back side of the front panel wall 252.

Among the cells 183, the outside wall reinforcing rib 180 defining a cell 183 having a wider area is formed to have a higher height from the front panel wall 252, compared to a cell 183 having a narrower area. The outside wall reinforcing rib 180 on the accommodating part for the stitch forming mechanism in the arm 6 or the bed 8 has a lower height from the front panel wall 252 than those of the outside wall reinforcing ribs 180 on the inside of the front panel wall 252 other than the accommodating part. The cells 183 in the vicinity of the accommodating part for the stitch forming mechanism have narrower areas than those of the cells 183 provided on the area other than the accommodating part. The reason the above arrangement has been adopted is the same as that of the main frame 1A, so that detailed explanation will be omitted.

The above arrangement of the outside wall reinforcing rib 180 ensures the sufficient rigidity of the front panel wall 252, thereby minimizing or restricting distortion appearing on the front panel wall 252 of the arm 6 due to the reciprocating motion of the needle 16. The above arrangement of the outside wall reinforcing rib 180 also minimizes distortion appearing on the front panel wall 252 of the cantilever support 7 and the bed 8 due to the distortion of the arm 6. In this embodiment, the outside wall reinforcing ribs 180 extend in vertical and horizontal directions on the front panel wall 252 to define the cells 183. This arrangement results in the sufficient rigidity of the front panel wall 252 in the case where the outside wall reinforcing rib 180 is not allowed to have a higher height in order that the frame cover 1B accommodates the stitch forming mechanism. Accordingly, a sewing machine having the above frame cover 1B can prevent vertical and horizontal vibrations of the frame cover 1B caused by the reciprocating motion of the needle 16, thereby performing a smooth stitch forming action.

It should be noted that the inside wall reinforcing rib 170 has a higher height from the front panel wall 252 than that of the outside wall reinforcing rib 180. More specifically, as shown in FIG. 14(A), at the base end of the arm 6, the inside wall reinforcing rib 170 is formed at a height from the front panel wall 252 reaching the dividing plane 52. In contrast, the vertical ribs 181 reach approximately halfway to the dividing plane 52 from the front panel wall 252. The reason is as follows: the inner surface wall 161 needs sufficient rigidity, because stress induced by the reciprocating motion of the needle 16 generally tends to concentrate on the inner surface wall 161.

In another embodiment, the outside wall reinforcing rib 180 may be provided on the only part of the frame cover 1B. Alternatively, the frame cover 1B may have no outside wall reinforcing rib 180. The frame cover 1B does not need so high rigidity as that of the main frame 1A.

Couplings

As shown in FIGS. 11 and 12, a plurality of couplings 190, 192, 194, and 196 are provided in the front panel wall 252 of the main frame 1A for joining the main frame 1A to the frame cover 1B. The coupling 190, 192, 194, and 196 are placed at positions corresponding to the positions of the couplings 90, 92, 94, and 94 of the main frame 1A. The coupling 190 is formed near the inner surface wall 161 in the area adjacent to the joint of the bed 8 and the cantilever support 7. More specially, the coupling 190 is placed in the vicinity of the inside wall reinforcing rib 170 formed outside of the inner surface wall 161. The above arrangement of the coupling 190 is aimed at preventing distortion of the arm 6 and the cantilever support 7 which causes swings of the top portion of the cantilever support 7 during the reciprocating motion of the needle 16. The coupling 192 is formed near the inner surface wall 161 at the joint area of the arm 6 and the cantilever support 7. More particularly, the coupling 192 is placed in the vicinity of the inside wall reinforcing rib 170 outside of the inner surface wall 161. The coupling 194 is formed near the inner surface wall 161 in the vicinity of the end of the inside wall reinforcing rib 170 near the arm 6. The couplings 192, 194 are placed on the circumference of the semicircle of the space 9 at constant intervals with respect to the coupling 190. A plurality of couplings 196 are formed on the sides and the corners of the inside of the back panel wall 250 in order to couple the main frame 1A and the frame cover 1B by a uniform pressure.

Screw holes 191, 193, 195, and 197 are formed inside the couplings 190, 192, 194, and 196. The main frame 1A and frame cover 1B can be detachably joined together by inserting screws (not shown) in the screw holes 191, 193, 195, and 197 when the couplings 190, 192, 194, and 196 are aligned with couplings 90, 92, 94, and 96 provided in corresponding positions on the main frame 1A.

Engaging Unit

As shown in FIG. 11, engaging units 111, 112, 113, and 114 are formed in the frame cover 1B at the dividing plane 52. These engaging units 111, 112, 113, and 114 engage with protrusions 100, 101, 102, and 103 provided on the main frame 1A at the dividing plane 52 (see FIG. 4) when the main frame 1A is joined with the frame cover 1B and function to limit the relative movement of the main frame 1A and frame cover 1B in the horizontal direction.

As shown in FIG. 15(A), the engaging unit 111 is recessed in the bottom of the arm 6 on the frame cover 1B at the dividing plane 52 and on one side of an opening 200 through which the mechanism for reciprocally driving the needle 16 protrudes downward. The engaging unit 111 engages with the protrusion 100 (see FIG. 4) formed on the arm 6 of the main frame 1A. This construction limits relative movement of the main frame 1A and frame cover 1B generated by vibrations and displacement at the dividing plane 52 of the arm 6.

As shown in FIG. 15(B), the engaging units 112 and 113 are recessed in the top of the bed 8 at the dividing plane 52 and on both sides of an opening 202 for exposing the rotary hook 23. The engaging units 112 and 113 engage with the protrusions 101 and 102 formed on the bed 8 of the main frame 1A (see FIG. 4). This construction restricts relative movement of the main frame 1A and frame cover 1B caused by vibrations and displacement at the dividing plane 52 of the bed 8.

As shown in FIG. 11, the engaging unit 114 is formed in a continuous channel on the inner surface 161 of the space 9. The protrusions 103 provided on the main frame 1A (see FIG. 4) engage with this channel portion. This construction restricts relative movement of the main frame 1A and frame cover 1B caused by vibrations and displacement at the dividing plane 52 of the space 9.

Protrusion

As shown in FIG. 15(A), the protrusion 104 is formed on the bottom of the arm 6 of the frame cover 1B at the dividing plane 52 and on the opposite side of the opening 200 as that in which the engaging unit 111 is formed. The protrusion 104 protrudes substantially perpendicularly to the frame cover 1B. The protrusion 104 fits in the engaging unit 110 provided on the arm 6 of the main frame 1A (see FIG. 4). This construction restricts relative movement of the main frame 1A and frame cover 1B caused by vibrations and displacement at the dividing plane 52 of the arm 6.

Recessed Top Edge

As shown in FIG. 14(A), the recessed step 126 is formed across nearly the entire top edge 125 on the frame cover 1B that contacts the main frame 1A for accommodating the raised step 121 formed on the top edge 120 of the main frame 1A and engaging the raised step 121 from the top. As shown in FIG. 14(B), the recessed step 126 comprises an engaging wall 127 protruding toward the main frame 1A for engaging the raised step 121 of the main frame 1A when the raised step 121 is guided to a prescribed position; a sliding surface 128 for guiding the raised step 121; and an accommodating portion 129 for accommodating the insertion part of the raised step 121. By accommodating the insertion part of the raised step 121 in the accommodating portion 129 and when the sliding surface of the raised step 121 engages with the sliding surface 128 from above, it is possible to limit relative movement of the main frame 1A in the upward direction.

The recessed step 136 is formed across nearly the entire bottom edge 135 of the frame cover 1B that contacts the main frame 1A for accommodating the raised step 131 formed on the bottom edge 130 of the main frame 1A and engaging the raised step 131 from below. While a detailed construction of the recessed step 136 is not shown in the drawings, this construction is basically the same as the recessed step 126 of the top edge 125 shown in FIG. 14(B). However, the recessed step 136 is vertically symmetrical to the recessed step 126. By engaging the raised step 131 with the recessed step 136, it is possible to limit the relative movement of the main frame 1A in the downward direction.

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A sewing machine frame for use in a sewing machine comprising:

a frame member formed of a synthetic resin and having a bed portion, a tower portion upstanding from the bed portion, and an arm portion extending from the tower portion at a position above the bed portion, the bed portion, the tower portion and the arm portion being formed integrally and providing a concaved peripheral wall defining a stitch working space; and a peripheral wall reinforcing rib protruding from the frame member, the peripheral wall reinforcing rib extending along the peripheral wall and ranging at least from a boundary between the bed portion and the tower portion to a boundary between the tower portion and the arm portion.

2. The sewing machine frame as claimed in claim 1, wherein the peripheral wall reinforcing rib comprises:

an elongated rib extending substantially along the peripheral wall and positioned spaced away therefrom; and a plurality of sectioning ribs each extending from the peripheral wall in a direction to intersect with the elongated rib for providing a plurality of partitioning cells defined by the peripheral wall, the elongated rib and the plurality of sectioning ribs.

3. The sewing machine frame as claimed in claim 2, wherein the elongated rib extends continuously along the peripheral wall.

4. The sewing machine frame as claimed in claim 3, wherein the peripheral wall is in a form of a semi-circular shape, and, wherein the plurality of sectioning ribs extend in a radial direction of the semi-circular shaped peripheral wall.

5. A sewing machine frame for use in a sewing machine comprising:

an outer panel wall constituting a front wall and a rear wall, the outer panel wall having a peripheral edge;

a side wall protruding from the peripheral edge to provide a closed space with the outer panel wall and being formed integrally with the outer panel wall with a synthetic resin, a combination of the outer panel wall and the side wall providing a bed portion, a tower portion upstanding from the bed portion, and an arm portion extending from the tower portion and positioned above the bed portion, the side wall having a part providing a concaved peripheral wall which defines a stitch working space surrounded by the bed portion, the tower portion and the arm portion;

a peripheral wall reinforcing rib protruding from the outer panel wall and extending along the peripheral wall, the peripheral wall reinforcing rib ranging at least from a boundary between the bed portion and the tower portion to a boundary between the tower portion and the arm portion; and an outer panel wall reinforcing rib protruding from the outer panel wall for reinforcing the same.

6. The sewing machine frame as claimed in claim 5, wherein the peripheral wall reinforcing rib has a height from the outer panel wall higher than that of the outer panel wall reinforcing rib.

7. The sewing machine frame as claimed in claim 6, wherein the outer panel wall reinforcing rib is provided at substantially entire area of the outer panel wall, and comprises a plurality of horizontally extending ribs, and a plurality of vertically extending ribs intersecting with the horizontally extending ribs for defining a plurality of isolating cells.

8. The sewing machine frame as claimed in claim 5, further comprising a reinforcing member at a position between the outer panel wall and the peripheral wall reinforcing rib and provided integrally with the outer panel wall and the peripheral wall reinforcing rib, the reinforcing member having a generally semi-circular hollow cross-section, and having one end portion positioned in the arm portion and extending in a longitudinal direction thereof, and having another end portion positioned in the bed portion and extending in a longitudinal direction thereof.

9. A sewing machine frame including a bed portion, a tower portion upstanding from the bed portion, and an arm portion extending from the tower portion in a cantilevered fashion, a stitch forming mechanism of the sewing machine being assembled in the sewing machine frame; the sewing machine frame comprising:

an integral main frame body made from a synthetic resin and to which the stitch forming mechanism is assembled, the integral main frame body comprising a back panel wall having a first peripheral edge, and a first side wall integrally protruding from the first peripheral edge, the integral main frame body providing an arm section, a tower section and a bed section;

an integral frame cover made from a synthetic resin and attached to the main frame body, the integral frame cover comprising a front panel wall having a second peripheral edge, and a second side wall integrally protruding from the second peripheral edge for providing a complementary bed section to form the bed portion with the bed section, a complementary tower section to form the tower portion with the bed section, and a complementary arm section to form the arm portion with the arm section, the first side wall and the second side wall having parts defining a concave wall surroundingly provided by the combination of the arm portion, the tower portion, and the bed portion; and a concave wall reinforcing rib extending along the concave wall and ranging at least from a boundary between the bed portion and the tower portion to a boundary between the tower portion and the arm portion.

10. The sewing machine frame as claimed in claim 9, wherein the concave wall reinforcing rib has an outer peripheral portion, and the sewing machine frame further comprising a supplemental concave wall reinforcing rib positioned at the outer peripheral portion for reinforcing the concave wall reinforcing rib.

11. A sewing machine frame for use in a sewing machine comprising:

an outer panel wall constituting a front wall and a rear wall, the outer panel wall having a peripheral edge;

a side wall protruding from the peripheral edge to provide a closed space with the outer panel wall and being formed integrally with the outer panel wall with a synthetic resin, a combination of the outer panel wall and the side wall providing a bed portion extending in its longitudinal direction, a tower portion upstanding from the bed portion, and an arm portion extending in its longitudinal direction from the tower portion and positioned above the bed portion, and a congregated area among the bed portion, the tower portion and the arm portion providing a peripheral wall defining a stitch working space of the sewing machine; and a reinforcing member formed integrally with the outer panel wall and having a hollow cross-section, the reinforcing member being positioned along the peripheral wall and having one end portion positioned in the arm portion and extending in the longitudinal direction thereof, and having another end portion positioned in the bed portion and extending in the longitudinal direction thereof.

12. The sewing machine frame as claimed in claim 11, wherein the reinforcing member has a generally semi-circular cross-section.

13. The sewing machine frame as claimed in claim 11, wherein the arm portion has a base end connected to the tower portion, and a free end defined by the side wall; and wherein the one end portion of the reinforcing member has a tip end positioned adjacent to the free end.

14. The sewing machine frame as claimed in claim 11, wherein the bed portion has a base end connected to the tower portion, and a free end portion defined by the side wall; and wherein the another end portion of the reinforcing member has a tip end positioned adjacent to the free end of the bed portion.

15. The sewing machine frame as claimed in claim 11, further comprising a supplemental reinforcing member provided integrally with the outer panel wall and extending substantially in parallel with the reinforcing member.

16. A sewing machine frame including a bed portion, a tower portion upstanding from the bed portion, and an arm portion extending from the tower portion in a cantilevered fashion, a stitch forming mechanism of a sewing machine being assembled in the sewing machine frame; the sewing machine frame comprising:

an integral main frame body made from a synthetic resin and to which the stitch forming mechanism is assembled, the integral main frame body comprising a back panel wall having a peripheral edge, and a side wall integrally protruding from the peripheral edge, the integral main frame body providing an arm section, a tower section and a bed section, the side wall having a part defining a peripheral wall surroundingly provided by the combination of the arm section, the tower section and the bed section;

an integral frame cover serving as a front panel wall made from a synthetic resin and attached to the main frame body for providing a complementary bed section to form the bed portion with the bed section, a complementary tower section to form the tower portion with the tower section, and a complementary arm section to form the arm portion with the arm section; and a reinforcing member formed integrally with the main frame body and having a hollow cross-section, the reinforcing member being positioned along the peripheral wall and having one end portion positioned in the arm section and extending in the longitudinal direction thereof, and having another end portion positioned in the bed section and extending in the longitudinal direction thereof.

17. The sewing machine frame as claimed in claim 16, wherein the reinforcing member has a generally semi-circular cross-section.

18. The sewing machine frame as claimed in claim 16, wherein the arm section has a base end connected to the tower section, and a free end defined by the side wall; and wherein the one end portion of the reinforcing member has a tip end positioned adjacent to the free end.

19. The sewing machine frame as claimed in claim 16, wherein the bed section has a base end connected to the tower section, and a free end portion defined by the side wall; and wherein the another end portion of the reinforcing member has a tip end positioned adjacent to the free end of the bed section.

20. The sewing machine frame as claimed in claim 16, further comprising a supplemental reinforcing member provided integrally with the main frame body and extending substantially in parallel with the reinforcing member.

21. A sewing machine comprising:

a stitch forming mechanism; and a sewing machine frame comprising a frame member formed of a synthetic resin and having a bed portion, a tower portion upstanding from the bed portion, and an arm portion extending from the tower portion at a position above the bed portion, the bed portion, the tower portion and the arm portion being formed integrally and providing a peripheral wall defining a stitch working space surrounded by the bed portion, the tower portion and the arm portion; and a peripheral wall reinforcing rib protruding from the frame member, the peripheral wall reinforcing rib extending along the peripheral wall and ranging at least from a boundary between the bed portion and the tower portion to a boundary between the tower portion and the arm portion.

22. The sewing machine as claimed in claim 21, wherein the peripheral wall reinforcing rib comprises:

an elongated rib extending substantially along the peripheral wall and positioned spaced away therefrom; and a plurality of sectioning ribs each extending from the peripheral wall in a direction to intersect with the elongated rib for providing a plurality of partitioning cells defined by the peripheral wall, the elongated rib and the plurality of sectioning ribs.

23. The sewing machine as claimed in claim 22, wherein the elongated rib extends continuously along the peripheral wall.

24. The sewing machine as claimed in claim 23, wherein the peripheral wall is in a form of a semi-circular shape, and, wherein the plurality of sectioning ribs extend in a radial direction of the semi-circular shaped peripheral wall.

25. A sewing machine comprising:

a stitch forming mechanism; and a sewing machine frame comprising an outer panel wall constituting a front wall and a rear wall, the outer panel wall having a peripheral edge;

a side wall protruding from the peripheral edge to provide a closed space with the outer panel wall and being formed integrally with the outer panel wall with a synthetic resin, a combination of the outer panel wall and the side wall providing a bed portion, a tower portion upstanding from the bed portion, and an arm portion extending from the tower portion and positioned above the bed portion, the side wall having a part providing a peripheral wall at a congregated area among the bed portion, the tower portion and the arm portion for defining a stitch working space surrounded by the bed portion, the tower portion and the arm portion;

a peripheral wall reinforcing rib protruding from the outer panel wall and extending along the peripheral wall, the peripheral wall reinforcing rib ranging at least from a boundary between the bed portion and the tower portion to a boundary between the tower portion and the arm portion; and an outer panel wall reinforcing rib protruding from the outer panel wall for reinforcing the same.

26. The sewing machine as claimed in claim 25, wherein the peripheral wall reinforcing rib has a height from the outer panel wall higher than that of the outer panel wall reinforcing rib.

27. The sewing machine as claimed in claim 26, wherein the outer panel wall reinforcing rib is provided at substantially entire area of the outer panel wall, and comprises a plurality of horizontally extending ribs, and a plurality of vertically extending ribs intersecting with the horizontally extending ribs for defining a plurality of isolating cells.

28. The sewing machine as claimed in claim 25, further comprising a reinforcing member at a position between the outer panel wall and the peripheral wall reinforcing rib and provided integrally with the outer panel wall and the peripheral wall reinforcing rib, the reinforcing member having a hollow cross-section, and having one end portion positioned in the arm portion and extending in a longitudinal direction thereof, and having another end portion positioned in the bed portion and extending in a longitudinal direction thereof.

29. The sewing machine as claimed in claim 28, wherein the reinforcing member has a generally semi-circular cross-section.

30. A sewing machine comprising a stitch forming mechanism; and a sewing machine frame including a bed portion, a tower portion upstanding from the bed portion, and an arm portion extending from the tower portion in a cantilevered fashion, the stitch forming mechanism being assembled in the sewing machine frame; the sewing machine frame comprising:

an integral main frame body made from a synthetic resin and to which the stitch forming mechanism is assembled, the integral main frame body comprising a back panel wall having a first peripheral edge, and a first side wall integrally protruding from the first peripheral edge, the integral main frame body providing an arm section, a tower section and a bed section;

an integral frame cover made from a synthetic resin and attached to the main frame body, the integral frame cover comprising a front panel wall having a second peripheral edge, and a second side wall integrally protruding from the second peripheral edge for providing a complementary bed section to form the bed portion with the bed section, a complementary tower section to form the tower portion with the bed section, and a complementary arm section to form the arm portion with the arm section, the first side wall and the second side wall having parts defining a concave wall surroundingly provided by the combination of the arm portion, the tower portion, and the bed portion; and a concave wall reinforcing rib extending along the concave wall and ranging at least from a boundary between the bed portion and the tower portion to a boundary between the tower portion and the arm portion.

31. The sewing machine frame as claimed in claim 30, wherein the concave wall reinforcing rib has an outer peripheral portion, and the sewing machine frame further comprising a supplemental concave wall reinforcing rib positioned at the outer peripheral portion for reinforcing the concave wall reinforcing rib.

32. A sewing machine comprising:

a stitch forming mechanism; and a sewing machine frame comprising:

an outer panel wall constituting a front wall and a rear wall, the outer panel wall having a peripheral edge;

a side wall protruding from the peripheral edge to provide a closed space with the outer panel wall and being formed integrally with the outer panel wall with a synthetic resin, a combination of the outer panel wall and the side wall providing a bed portion extending in its longitudinal direction, a tower portion upstanding from the bed portion, and an arm portion extending in its longitudinal direction from the tower portion and positioned above the bed portion, and a congregated area among the bed portion, the tower portion and the arm portion providing a peripheral wall defining a stitch working space; and a reinforcing member formed integrally with the outer panel wall and having a hollow cross-section, the reinforcing member being positioned along the peripheral wall and having one end portion positioned in the arm portion and extending in the longitudinal direction thereof, and having another end portion positioned in the bed portion and extending in the longitudinal direction thereof.

33. The sewing machine as claimed in claim 32, wherein the reinforcing member has a generally semi-circular cross-section.

34. The sewing machine as claimed in claim 32, wherein the arm portion has a base end connected to the tower portion, and a free end defined by the side wall; and wherein the one end portion of the reinforcing member has a tip end positioned adjacent to the free end.

35. The sewing machine as claimed in claim 32, wherein the bed portion has a base end connected to the tower portion, and a free end portion defined by the side wall; and wherein the another end portion of the reinforcing member has a tip end positioned adjacent to the free end of the bed portion.

36. The sewing machine frame as claimed in claim 32, further comprising a supplemental reinforcing member provided integrally with the outer panel wall and extending substantially in parallel with the reinforcing member.

37. A sewing machine comprising:

a stitch forming mechanism; and a sewing machine frame including a bed portion, a tower portion upstanding from the bed portion, and an arm portion extending from the tower portion in a cantilevered fashion, the stitch forming mechanism being assembled in the sewing machine frame; the sewing machine frame comprising:

an integral main frame body made from a synthetic resin and to which the stitch forming mechanism is assembled, the integral main frame body comprising a back panel wall having a peripheral edge, and a side wall integrally protruding from the peripheral edge, the integral main frame body providing an arm section, a tower section and a bed section, the side wall having a part defining a peripheral wall surroundingly provided by the combination of the arm section, the tower section and the bed section;

an integral frame cover serving as a front panel wall made from a synthetic resin and attached to the main frame body for providing a complementary bed section to form the bed portion with the bed section, a complementary tower section to form the tower portion with the tower section, and a complementary arm section to form the arm portion with the arm section; and a reinforcing member formed integrally with the main frame body and having a hollow cross-section, the reinforcing member being positioned along the peripheral wall and having one end portion positioned in the arm section and extending in the longitudinal direction thereof, and having another end portion positioned in the bed section and extending in the longitudinal direction thereof.

38. The sewing machine as claimed in claim 37, wherein the reinforcing member has a generally semi-circular cross-section.

39. The sewing machine as claimed in claim 37, wherein the arm section has a base end connected to the tower section, and a free end defined by the side wall; and wherein the one end portion of the reinforcing member has a tip end positioned adjacent to the free end.

40. The sewing machine as claimed in claim 37, wherein the bed section has a base end connected to the tower section, and a free end portion defined by the side wall; and wherein the another end portion of the reinforcing member has a tip end positioned adjacent to the free end of the bed section.

41. The sewing machine as claimed in claim 37, further comprising a supplemental reinforcing member provided integrally with the main frame body and extending substantially in parallel with the reinforcing member.

* * * * *